US009415597B2

(12) United States Patent
Kawakubo et al.

(10) Patent No.: US 9,415,597 B2
(45) Date of Patent: Aug. 16, 2016

(54) INK JET HEAD HAVING NOZZLE PLATE EQUIPPED WITH PIEZOELECTRIC ELEMENTS

(71) Applicants: KABUSHIKI KAISHA TOSHIBA, Tokyo (JP); TOSHIBA TEC KABUSHIKI KAISHA, Tokyo (JP)

(72) Inventors: Takashi Kawakubo, Kanagawa (JP); Kazuhide Abe, Kanagawa (JP); Yasushi Tomizawa, Tokyo (JP); Ryuichi Arai, Shizuoka (JP); Ryutaro Kusunoki, Shizuoka (JP); Osamu Takagi, Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/199,696

(22) Filed: Mar. 6, 2014

(65) Prior Publication Data

US 2015/0085022 A1 Mar. 26, 2015

(30) Foreign Application Priority Data

Sep. 20, 2013 (JP) ..... 2013-194963

(51) Int. Cl.
*B41J 2/015* (2006.01)
*B41J 2/16* (2006.01)

(52) U.S. Cl.
CPC ..... *B41J 2/1628* (2013.01); *B41J 2/161* (2013.01); *B41J 2/1606* (2013.01); *B41J 2/1607* (2013.01); *B41J 2/1626* (2013.01); *B41J 2202/03* (2013.01); *B41J 2202/15* (2013.01)

(58) Field of Classification Search
None
See application file for complete search history.

(56) References Cited

U.S. PATENT DOCUMENTS

| | | | | |
|---|---|---|---|---|
| 8,608,296 | B2 | 12/2013 | Nakatani | |
| 2004/0140732 | A1* | 7/2004 | Truninger et al. | 310/300 |
| 2005/0012783 | A1* | 1/2005 | Kuk et al. | 347/65 |
| 2005/0157092 | A1* | 7/2005 | Park | 347/68 |
| 2008/0007594 | A1 | 1/2008 | Cha et al. | |
| 2009/0114121 | A1* | 5/2009 | Morohoshi et al. | 106/31.86 |
| 2013/0010021 | A1 | 1/2013 | Umeda | |
| 2013/0100211 | A1 | 4/2013 | Kawakubo et al. | |
| 2015/0062254 | A1 | 3/2015 | Kawakubo et al. | |

FOREIGN PATENT DOCUMENTS

| | | | |
|---|---|---|---|
| JP | H3-065350 | A | 3/1991 |
| JP | H11-291495 | A | 10/1999 |
| JP | 2013-086287 | A | 5/2013 |

OTHER PUBLICATIONS

U.S. Appl. No. 14/075,423, filed Nov. 8, 2013.

* cited by examiner

*Primary Examiner* — Erica Lin
(74) *Attorney, Agent, or Firm* — Patterson & Sheridan, LLP

(57) ABSTRACT

An ink jet head includes: a pressure chamber to be filled with ink formed in a pressure chamber structure, the pressure chamber in which an etching limiter made of a material different from a material of the pressure chamber structure is formed on an inner wall surface of the pressure chamber; a nozzle plate comprising a nozzle that leading to the pressure chamber and a movable range fitted to the etching limiter; and a flat driver comprising a piezoelectric body to operate the movable range and arranged on the nozzle plate.

16 Claims, 16 Drawing Sheets

[Table 1]

| | |
|---|---|
| pressure generating chamber diameter (nozzle plate movable range) α1 | 200 μm |
| nozzle plate thickness | 4 μm |
| nozzle plate aperture diameter | 20 μm |
| nozzle plate center section diameter | 100 μm |
| lower electrode thickness | 0.1 μm |
| piezoelectric film thickness | 2 μm |
| upper electrode thickness | 0.1 μm |

[Table 2]

| | |
|---|---|
| pressure generating chamber diameter (nozzle plate movable range) α1 | 200 μm |
| nozzle plate thickness | 4 μm |
| nozzle plate aperture diameter | 20 μm |
| piezoelectric element diameter γ1 | 140 μm |
| lower electrode thickness | 0.1 μm |
| piezoelectric film thickness | 2 μm |
| upper electrode thickness | 0.1 μm |

[Table 3]

| | |
|---|---|
| pressure generating chamber width (nozzle plate movable range in width direction) λ1 | 200 μm |
| pressure generating chamber length | 400 μm |
| nozzle plate thickness | 4 μm |
| nozzle plate aperture diameter | 20 μm |
| lower electrode thickness | 0.1 μm |
| piezoelectric film thickness | 2 μm |
| upper electrode thickness | 0.1 μm |

INK JET HEAD HAVING NOZZLE PLATE EQUIPPED WITH PIEZOELECTRIC ELEMENTS

CROSS-REFERENCE TO RELATED APPLICATIONS

This application is based upon and claims the benefit of priority from the prior Japanese Patent Application No. 2013-194963, filed on Sep. 20, 2013, and the entire contents of which are incorporated herein by reference.

FIELD

The embodiments of the present invention as described herein relate to an ink jet head for ejecting ink from nozzles.

BACKGROUND

Ink jet heads having a nozzle plate that is equipped with flat piezoelectric elements arranged on the front surface of a silicon substrate and pressurizing chambers (pressure generating chambers) formed by wet etching the silicon substrate from the back surface thereof are known.

Ink jet heads in which pressure generating chambers are formed by etching the silicon substrate thereof from the rear surface can give rise to a large dispersion in terms of shape or dimensions of pressure generating chambers depending on etching accuracy. As the movable ranges of the nozzle plate of the ink jet head show dispersion due to the dispersion of shape and/or dimensions of pressure generating chambers, the ink ejecting capabilities of the nozzles also shows dispersion. Then, as the ink ejecting capabilities of the nozzles vary, there arises a risk of making it impossible to produce high definition images.

DETAILED DESCRIPTION

Embodiments of ink jet head of the present invention includes: a pressure chamber to be filled with ink formed in a pressure chamber structure, the pressure chamber in which an etching limiter made of a material different from a material of the pressure chamber structure is formed on an inner wall surface of the pressure chamber; a nozzle plate comprising a nozzle that leading to the pressure chamber and a movable range fitted to the etching limiter; and a flat driver comprising a piezoelectric body to operate the movable range and arranged on the nozzle plate.

Embodiments of the present invention will be described below.

(First Embodiment)

Figure 1:
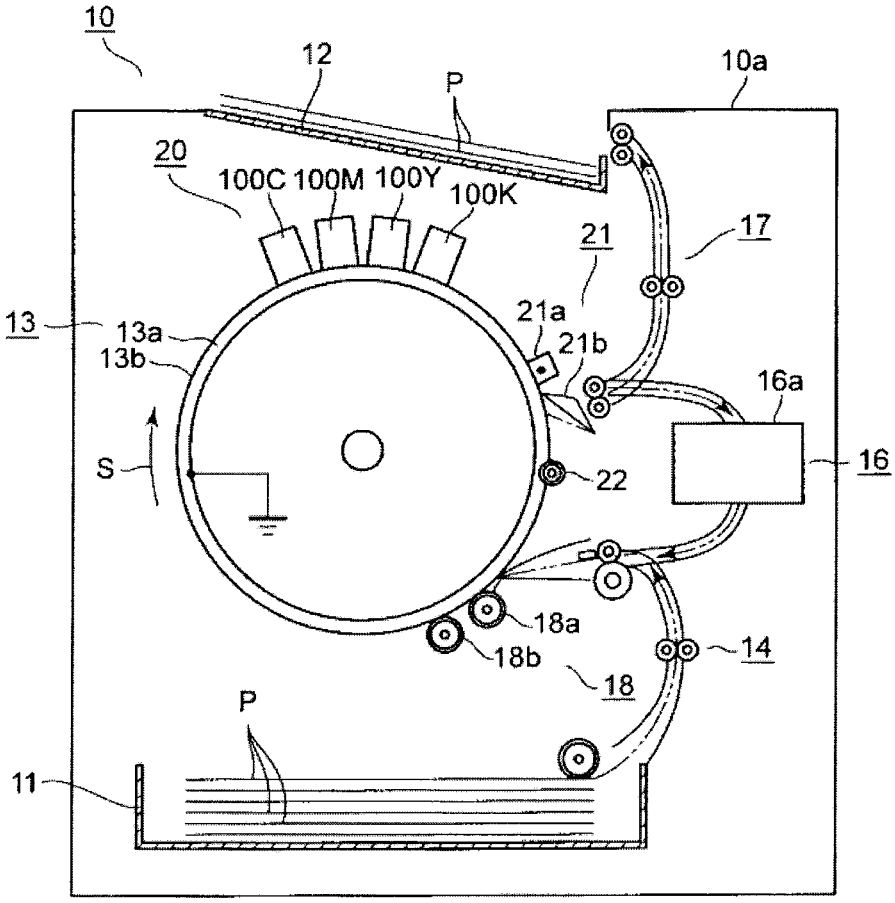
FIG. 1 is a schematic illustration of the first embodiment of ink jet recording apparatus.

The first embodiment of ink jet head according to the present invention will be described below by referring to FIGS. 1 through 7. FIG. 1 is a schematic illustration of an ink jet recording apparatus, which is in fact an ink jet printer 10 that incorporates the first embodiment. The ink jet printer 10 illustrated in FIG. 1 executes various processes including an image forming process, while conveying a sheet of recording paper P that is a recording medium. The inkjet printer 10 includes a cabinet 10*a*, a paper feeding cassette 11, a paper discharge tray 12, a holding roller 13, a paper feeding conveyer 14, a reverser 16 and a paper discharging conveyer 17. The ink jet printer 10 also includes a holder 18, an image former 20, a peeler 21 and a cleaner 22 arranged around the holding roller 13.

The paper feeding cassette 11 contains unprinted sheets of recording paper P. The paper discharge tray 12 receives and contains the sheets of recording paper P that are discharged from the cabinet 10*a* after an image is formed on each of the recording paper P. The paper feeding conveyer 14 feeds the sheet of recording paper P taken out from the paper feeding cassette 11 to the holding roller 13.

The holding roller 13 is formed by laying a thin insulation layer 13*b* on the surface of a cylindrical frame 13 that is made of a conductor of electricity such as aluminum. The cylindrical frame 13*a* is grounded. The holding roller 13 is driven to rotate in the sense indicated by arrow s in FIG. 1, while holding a sheet of recording paper P on the surface thereof to convey the sheet of recording paper P. The holder 18 includes a pressing roller 18*a* for pressing the sheet of recording paper P against the holding roller 13 and a charging roller 18*b* for causing the holding roller 13 to adsorb the sheet of recording paper P by electrostatic force resulting from their electric charge.

The image former 20 typically includes ink jet heads 100C, 100M, 100Y and 100K. The ink jet heads 100C, 100M, 100Y and 100K are for respectively ejecting cyan ink, magenta ink, yellow ink and black ink and printing an intended image on the sheet of recording paper P that is held to the surface of the holding roller 13.

The peeler 21 includes a static eliminator charger 21*a* and a peeling pawl 21*b*. The static eliminator charger 21*a* removes electricity from the sheet of recording paper P by applying electric charge to the sheet of recording paper P. The peeling pawl 21*b* peels off the sheet of recording paper P from the surface of the holding roller 13. When the printing process is completed, the peeler 21 discharges the sheet of recording paper P that is peeled off from the holding roller 13 to the discharge tray 12 by means of the paper discharging conveyer 17. When the sheet of recording paper P is to be subjected to duplex printing, the peeler 21 causes the sheet of recording paper P that has been peeled off from the holding roller 13 to be reversed by the reverser 16 and supplies it to the holding roller 13 once again. The reverser 16 is provided with a backward feeding path 16*a* for moving back the sheet of recording paper P in the opposite direction and turns the sheet of recording paper P that is peeled off from the holding roller 13 upside down. The cleaner 22 cleans the surface of the holding roller 13.

The ink jet heads 100C, 100M, 100Y and 100K of the image former 20 will be described below. The ink jet heads 100C, 100M, 100Y and 100K have the same configuration although they use ink of respective colors that are different from each other. The configuration of the ink jet heads 100C, 100M, 100Y and 100K will be described by using symbols that commonly denote their components.

Figure 2:
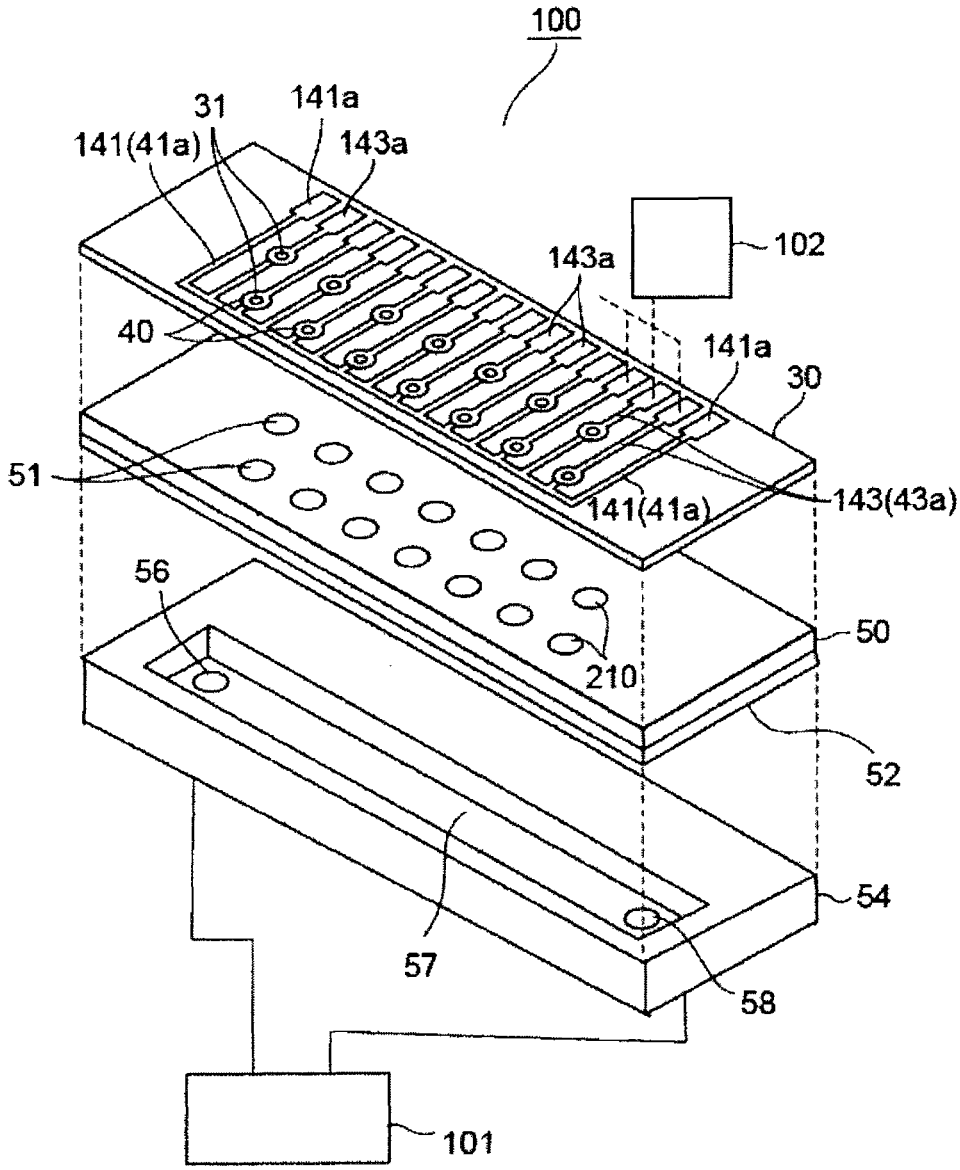
FIG. 2 is an exploded schematic perspective view of the first embodiment of ink jet head.

FIG. 2 schematically illustrates an ink jet head 100. For example, the ink jet head 100 is an MEMS (micro electro mechanical system) type ink jet head. The ink jet head 100 includes a pressure chamber structure 50, a back plate 52, a nozzle plate 30 and an ink flow path structure 54. The ink jet head 100 is connected to ink tank 101 and controller 102.

The nozzle plate 30 is formed on the first surface of the pressure chamber structure 50 and the back plate 52 is arranged on the second surface that is the surface opposite to the first surface of the pressure chamber structure 50 where the nozzle plate is arranged.

The ink jet head 100 fills ink into circular pressure generating chambers 51 that are pressure chambers formed in the pressure chamber structure 50. Ink is supplied from the ink tank 101 by way of the ink flow path structure 54. Then, the ink jet head 100 ejects ink from the pressure generating chambers 51 that are filled with ink. More specifically, the ink jet head 100 ejects ink in the form of ink droplets through a plurality of nozzles 31 that are formed in the nozzle plate 30. The plurality of nozzles 31 may typically be arranged in the nozzle plate 30 in two rows.

The ink flow path structure 54 includes an ink inflow port 56, an ink flow path 57 and an ink discharge port 58. The ink flow path structure 54 makes ink flow from ink holes 53 of the back plate 52 shown in FIG. 4 into the corresponding pressure generating chambers 51 as ink is supplied from the ink inflow port 56 into the ink flow path 57. The ink in the ink flow path 57 is discharged from the ink discharge port 58 into the ink tank 101. The ink jet head 100 circulates ink between the ink tank 101 and the ink flow path 57.

Figure 3:
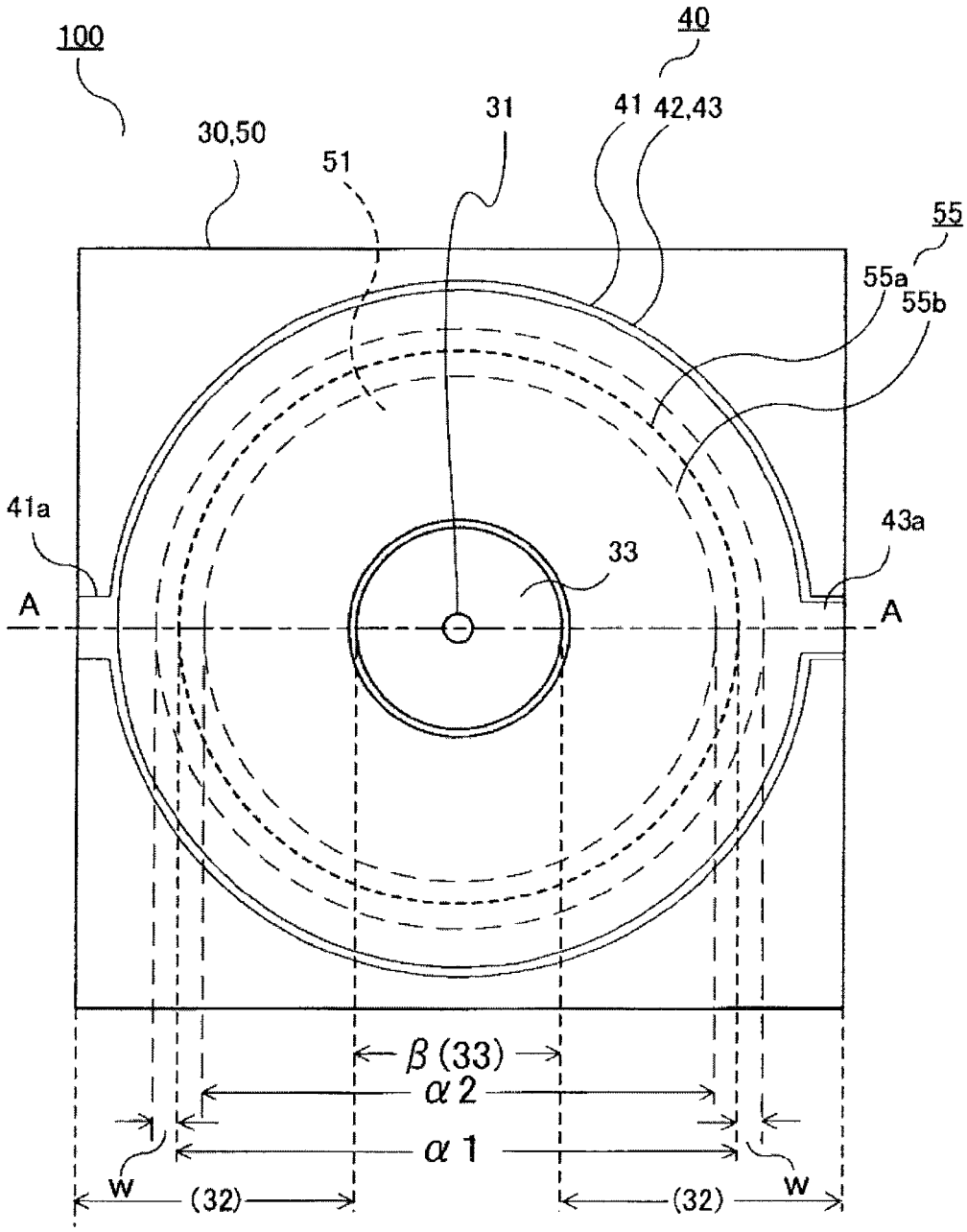
FIG. 3 is a partial top view of the first embodiment of ink jet head.
Figure 4:
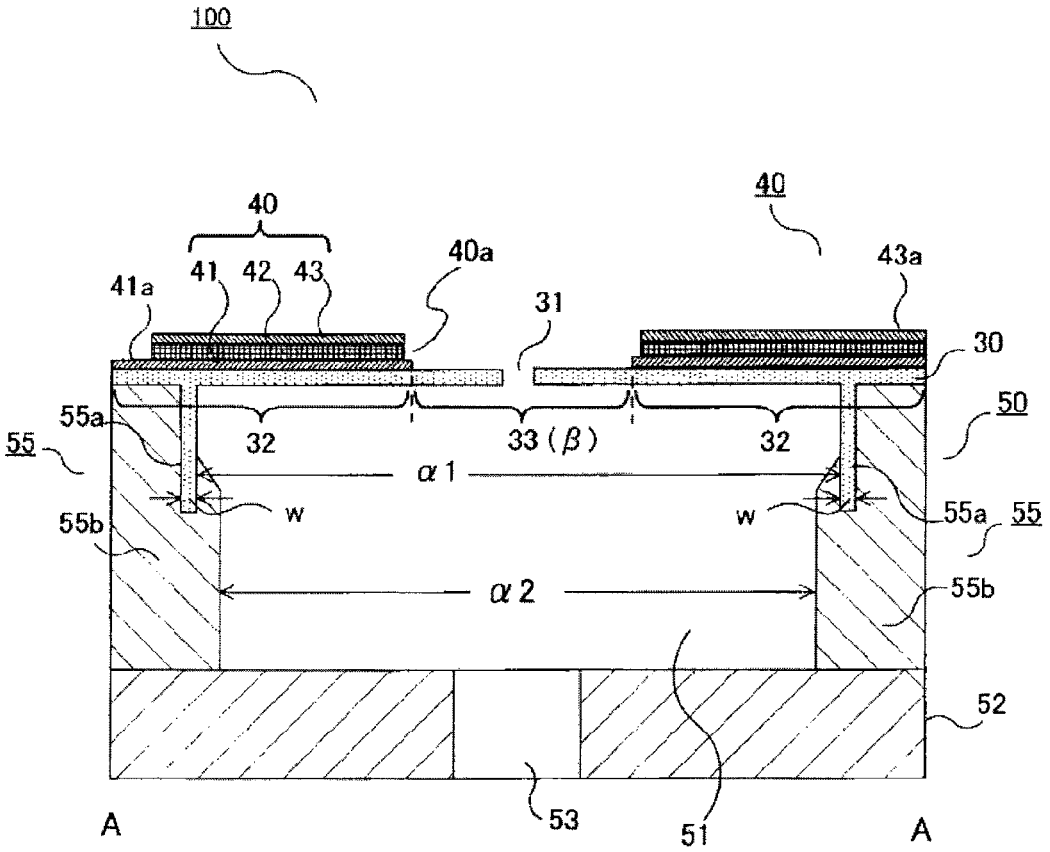
FIG. 4 is a schematic cross-sectional partial view of the first embodiment of ink jet head taken along line A-A in FIG. 3.

As shown in FIGS. 3 and 4, the nozzle plate 30 is provided with piezoelectric elements 40 that are arranged around the respective nozzles 31 as flat elements so as to operate as driver. The nozzle plate 30 fluctuates in the thickness direction thereof as the flat piezoelectric elements 40 operate. The ink jet head 100 ejects ink from the nozzles 31 due to energy changes that take place in the pressure generating chambers 51 as the nozzle plate 30 fluctuates.

The pressure generating chambers 51 are formed to show a circular top view in the pressure chamber structure 50 that is typically formed by a silicon substrate (Si substrate). The thickness of the silicon substrate of the pressure chamber structure 50 may typically well be between about 100 to 600 μm. Preferably, the thickness of the silicon substrate is between about 150 to 250 μm in order to obtain a satisfactory degree of rigidity for bulkheads 55 arranged between adjacently located pressure generating chambers 51 and also realize a high arrangement density for the flat pressure generating chambers 51. Each of the pressure generating chambers 51 is surrounded by the nozzle plate 30, the corresponding one of the bulkheads 55 and the back plate 52.

The bulkheads 55 are etching limiter and each of them includes an annular silicon oxide film lateral wall 55*a* having an inner diameter of $\alpha 1$ and a thickness of w. Each of the bulkheads 55 also includes a silicon film lateral wall 55*b*, which has an inner diameter of $\alpha 2$ and is designed to operate as etching surface of the pressure chamber structure 50. Thus, each of the pressure generating chambers 51 includes a region having an inner diameter of $\alpha 1$ and a region having an inner diameter of $\alpha 2$.

The nozzle plate 30 is typically made of silicon dioxide ($SiO_2$) film that is integrally formed with the pressure chamber structures 50. It is produced integrally with the bulkheads 55 of the pressure chamber structures 50. The top end of the silicon oxide film lateral wall 55*a* and the top end of the silicon film lateral wall 55*b* of each of the bulkheads 55 are rigidly secured to the nozzle plate 30. The nozzle plate 30 has movable ranges with a diameter of $\alpha 1$ that is defined by the silicon oxide film lateral walls 55*a*. The thickness of the nozzle plate 30 is typically between 1 to 5 μm.

Since silicon dioxide ($SiO_2$) film is preferable as the material of the nozzle plate 30 from the viewpoint that it is amorphous and hence can be evenly deformed. Moreover, amorphous silicon dioxide ($SiO_2$) film is preferably employed for the nozzle plate 30 from the viewpoint of manufacturing film having a stable composition and stable characteristics. Furthermore, amorphous silicon dioxide ($SiO_2$) film is preferably employed for forming the nozzle plate 30 from the viewpoint that it matches well with known semiconductor manufacturing processes. The material of the nozzle plate 30 is not limited to silicon dioxide ($SiO_2$) film. It is also preferable to use silicon nitride (SiN) film as the material of the nozzle plate 30 to realize uniform deformation of the nozzle plate.

The nozzles 31 are formed in the nozzle plate 30 typically by etching. The size of the pressure generating chambers 51 and that of the nozzles 31 should be optimized according to the quantity of ink droplets that are to be ejected from the nozzles 31, the rate of ink ejection and the frequency of ink ejection. For example, when 360 ink droplets are to be employed per inch for recording, the nozzles 30 are preferably accurately formed with a groove width of tens of several μm.

The piezoelectric elements 40 are arranged around the respective nozzles 31. For each of the piezoelectric elements 40, a lower electrode 41 and an upper electrode 43 are laid to vertically sandwich a piezoelectric film 42, which is a piezoelectric body, between them and produce a multilayer structure. The lower electrodes 41 are made to have extended parts 41*a*, which operate as part of external wires 141, which external wires 141 are connected to two terminals 141*a*. The upper electrodes 43 are made to have extended parts 43*a* along with the piezoelectric films 42 and the lower electrodes 41 that are underlying layers so that the extended parts 43*a* operates as a part of external wires 143. External wires 143 are arranged in parallel between two terminals 141*a* of the lower electrodes 41 and connected to a plurality of terminals 143*a*.

The controller 102 controls on/off of voltage application to the terminals 143*a* and supplies electric signals to the piezoelectric elements 40. The piezoelectric elements 40 are formed on the nozzle plate 30 above the surrounding regions 32 of the respective pressure generating chambers 51.

The nozzle plate 30 has circular center sections 33 having a diameter of β, each of which is a hole region surrounding the corresponding nozzle 31. The piezoelectric elements 40 are not found in the circular center sections 33. Each of the piezoelectric elements 40 is annular-shaped and extends from above the corresponding bulkhead 55 of the nozzle plate 30 toward the nozzle 31 to get to above the region of the corresponding pressure generating chamber 51. The center sections 33 of the nozzle plate 30 in which no annular-shaped piezoelectric elements 40 are found can freely fluctuate in the thickness direction. The width of the center sections 33 of the nozzle plate 30 is not limited so long as the nozzle plate 30 can be made to fluctuate by the operation of the piezoelectric elements 40.

A piezoelectric material showing a large electrostriction constant such as lead zirconate titanate ($(Pb(Zr, Ti)O_3$, PZT) is suitable for the piezoelectric films 42 of the piezoelectric elements 40. When PZT is employed for the piezoelectric films 42, the use of a noble metal such as Pt (platinum), Au (gold) or Ir (iridium) or an electro-conductive oxide such as $SrRuO_3$ (strontium ruthenate) is suitable as material for the lower electrodes 41 or the upper electrodes 43.

A piezoelectric material that is suited for a silicon process for producing aluminum nitride (AlN) or zinc dioxide ($ZnO_2$) can be used for the piezoelectric films 42. When aluminum nitride or zinc dioxide is employed for the piezoelectric films 42, a popular electrode material or a wire material such as Al (aluminum) or Cu (copper) can be used for the lower electrodes 41 or the upper electrodes 43.

Figure 5A:
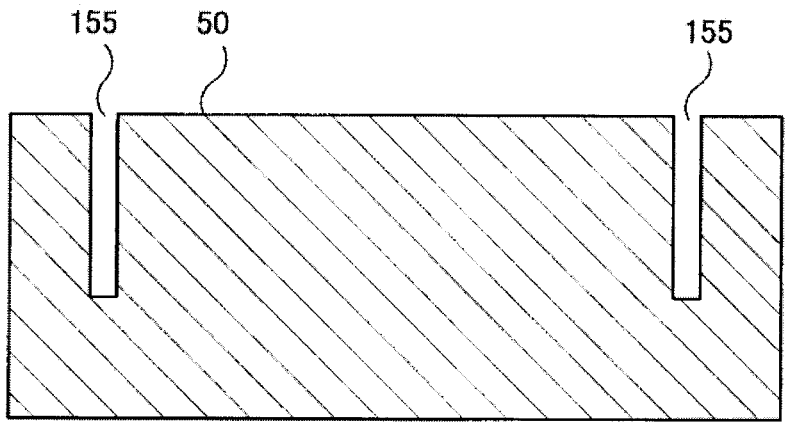
FIG. 5A is a schematic cross-sectional partial view of the pressure chamber structure of the first embodiment having grooves formed therein.

An exemplar method of manufacturing ink jet heads 100 will be described below. The first surface of the pressure chamber structure 50 is subjected to a patterning process to produce annular groves 155 having an inner diameter of α1 in the pressure chamber structure 50, which is a silicon single crystal substrate, typically by means of photolithography and reactive ion etching (RIE) (FIG. 5A).

Figure 5B:
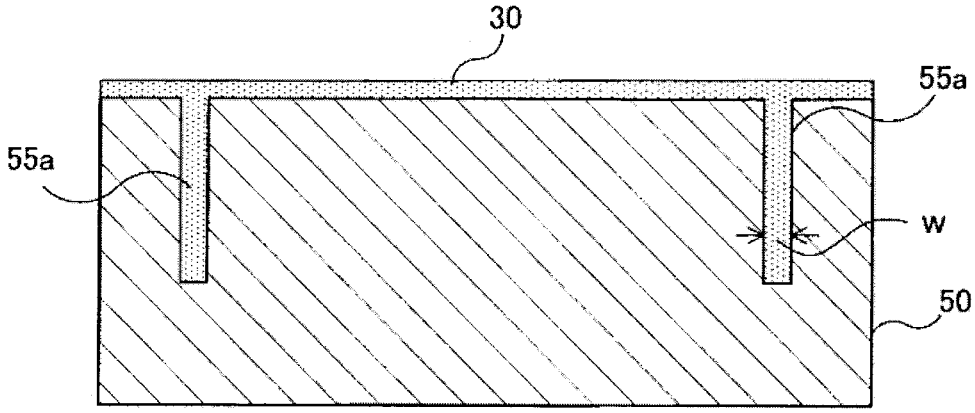
FIG. 5B is a schematic cross-sectional partial view of the pressure chamber structure of the first embodiment having a nozzle plate formed thereon and silicon oxide film lateral wall formed therein.
Figure 5C:
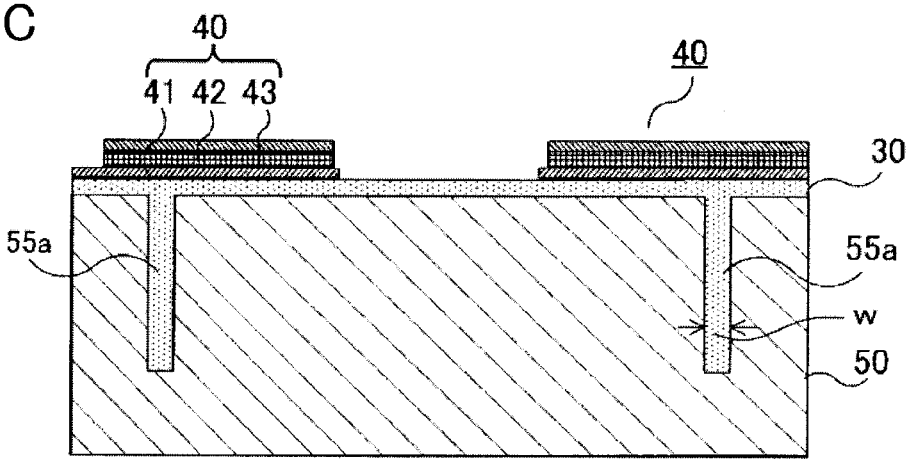
FIG. 5C is a schematic cross-sectional partial view of the pressure chamber structure of the first embodiment having a piezoelectric element formed in the nozzle plate thereof.

Then, silicon oxide ($SiO_2$) film is formed on the first surface of the pressure chamber structure 50 now having the annular grooves 155 by a thermal oxidation method to produce a nozzle plate 30. When the silicon plate 30 is formed, annular silicon film lateral walls 55*a* made of silicon dioxide ($SIO_2$) film and having a thickness of w are also formed simultaneously by means of a thermal oxidation method (FIG. 5B).

When the first surface of the pressure chamber structure 50 is subjected to a thermal oxidation process, the insides of the grooves 155 are filled with silicon dioxide ($SiO_2$) film to produce the silicon oxide film lateral walls 55*a* by adjusting the width of the grooves 155 and the thickness of the oxide film. A large volume expansion arises when Si is oxidized to become silicon dioxide. Oxide film is produced by oxidation such that 44% thereof is found under the surface and 56% thereof is found on the surface as a result of oxidation. Thus, the grooves 155 can be completely filled so as to become integral with the nozzle plate 30 by forming an oxide film whose thickness is 100/(56×2)=0.89 times of the width of the grooves 155 in each of the groves 155.

The nozzle plate 30 and the silicon oxide film lateral walls 55*a* can also be formed by means of plasma CVD or CVD using TEOS (tetraethyl orthosilicate). Furthermore, they can also be formed by using a thermal oxidation method and a CVD method in combination.

Thereafter, piezoelectric elements 40 are formed on the nozzle plate 30. A film forming step and a patterning step are repeated to form the piezoelectric elements 40. The film forming step is executed by means of sputtering or CVD. The patterning step is executed typically by means of photolithography and RIE. For example, the patterning step is executed by forming an etching mask on the formed film, using photosensitive resist, etching the film material and subsequently removing the etching mask.

Pt (platinum) film is formed as the material of the lower electrodes 41 on the nozzle plate 30 typically by sputtering and PZT (lead zirconate titanate) film is formed as the material of the piezoelectric films 42. Subsequently, Pt (platinum) film is formed as the material of the upper electrodes 43. Then, the upper Pt (platinum) film and the PZT (lead zirconate titanate) film are subjected to a patterning operation to produce upper electrodes 43 and piezoelectric films 42 by means of photolithography and RIE. Furthermore, the lower Pt (platinum) film is subjected to a patterning operation by means of photolithography and RIE (see FIG. 5C). The lower electrode 41 or the upper electrode 43 may, for example, have a multilayer structure formed by using, for example, Ti (titanium) film and Pt (platinum) film.

Figure 5D:
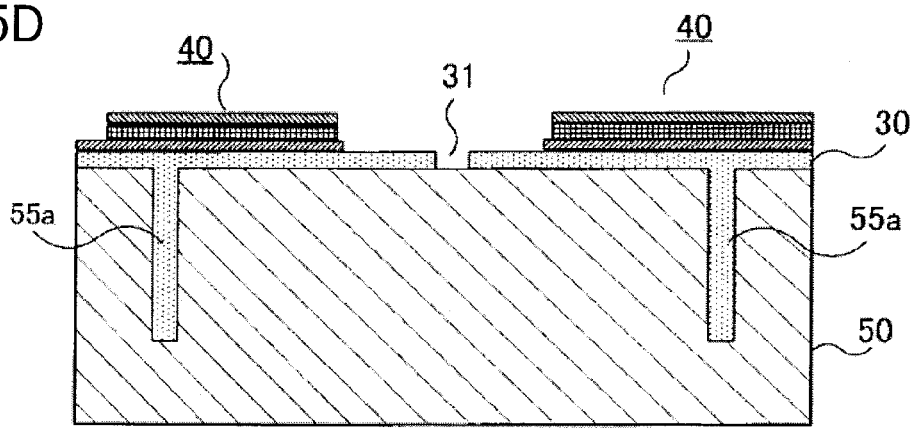
FIG. 5D is a schematic cross-sectional partial view of the pressure chamber structure of the first embodiment having a nozzle formed in the nozzle plate thereof.

Thereafter, the nozzle plate 30 is subjected to a patterning operation to form nozzles 31 in it by means of photolithography and RIE (FIG. 5D).

Figure 5E:
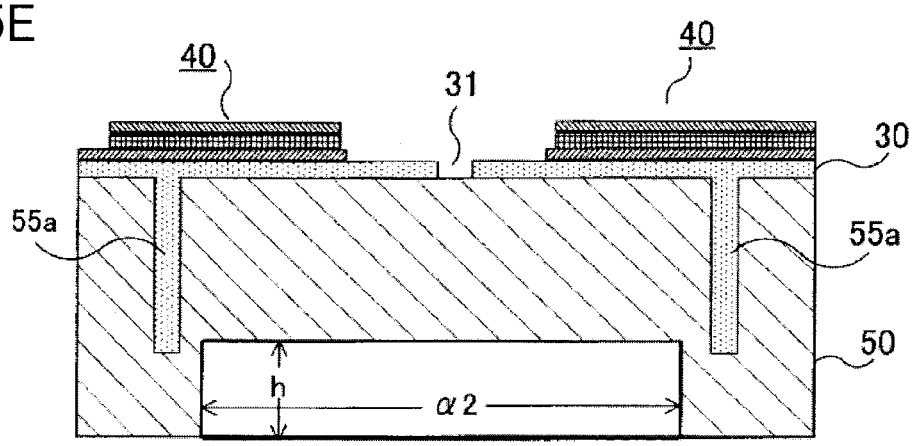
FIG. 5E is a schematic cross-sectional partial view of the pressure chamber structure of the first embodiment, in which the pressure chamber structure is etched to depth h from the second surface thereof.

Then, as a preliminary step, the pressure chamber structure 50 is etched from the side of the second surface thereof that is the surface opposite to the side where the nozzle plate 30 is arranged by means of photolithography and deep reactive ion etching (D-RIE). For example, an etching step and a lateral wall passivation step are repetitively executed on the pressure chamber structure 50 until a depth of h that corresponds to the front end positions of the silicon oxide film lateral walls 55*a* is reached by using a pattern having a diameter of α2 (FIG. 5E).

Figure 5F:
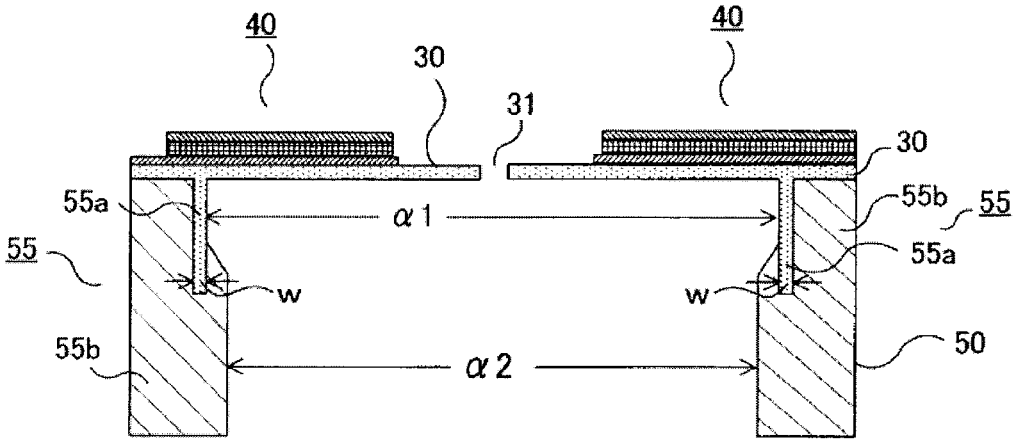
FIG. 5F is a schematic cross-sectional partial view of the pressure chamber structure of the first embodiment, in which a bulk head is formed in the pressure chamber structure.

After etching the pressure chamber structure 50 to the depth of h, a pressure chamber forming step is executed. In the pressure chamber forming step, the pressure chamber structure 50 is etched under the condition of gradually extending the etching diameter from diameter α2 to diameter α1, debilitating the lateral wall passivation by D-RIE. The pressure chamber structure 50 is etched until getting to the nozzle plate 30 to expose the silicon oxide film lateral walls 55*a* and produce the bulkheads 55 (FIG. 5F).

If the etching rate for etching silicon (Si) is 100, the etching rate for etching the silicon dioxide ($SiO_2$) film and getting to the nozzle plate 30 from the depth h is made to be not greater than 1. The risk of over-etching the silicon oxide film lateral walls 55*a* and/or the nozzle plate 30 is prevented by using a low etching rate for silicon dioxide ($SiO_2$) film relative to silicon (Si). The silicon (Si) found in the inside of the silicon oxide film lateral walls 55*a* is reliably removed without over-etching along the inner surface of the silicon oxide film lateral walls 55*a* showing an inner diameter of α1. Note, however, that the etching rate for silicon (Si) and the etching rate for silicon dioxide ($SiO_2$) film are not subjected to any particular limitations for the purpose of the present invention.

The pressure generating chambers 51 having a diameter of α1 can highly accurately be formed by arranging the silicon oxide film lateral walls 55*a* and suppressing dispersion of shape and/or dimensions of the pressure generating chambers 51 at the side that contacts the nozzle plate 30. The movable ranges of the nozzle plate 30 can be constantly held to be equal to the diameter α1 by arranging the silicon oxide film lateral walls 55*a*.

Figure 5G:
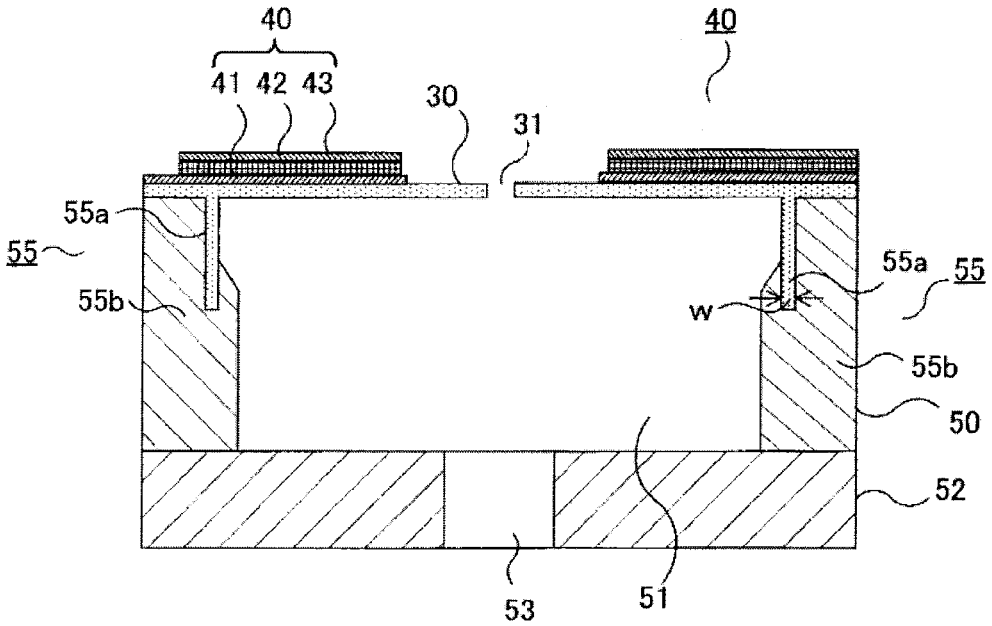
FIG. 5G is a schematic cross section partial view of the pressure chamber structure of the first embodiment, in which a back plate is bonded to the pressure chamber structure.

Subsequently, the pressure generating chambers are formed as a back plate 52 is bonded to the bulkheads 55 at the side opposite to the nozzle plate (FIG. 5G). For example, the back plate 52 may be bonded to the pressure chamber structure 50 by means of a silicon direct bonding method of subjecting it to a cleansing process in vacuum of cleansing the areas of the opposite surfaces of the back plate 52 that are to be bonded, bringing it into tight contact with the pressure chamber structure 50 and bonding it to the latter by applying pressure. Alternatively, the back plate 52 may be bonded to the pressure chamber structure 50 by means of an organic bonding agent.

Thereafter, an ink flow path structure 54 is bonded to the pressure chamber structure 50 to sandwich the back plate 52 between the pressure chamber structure 50 and the ink flow path structure 54. The pressure generating chambers 51 of the pressure chamber structure 50 communicate with the ink flow path 57 in the ink flow path structure 54 by way of the respective ink holes 53 of the back plate 52. Thus, an inkjet head 100 provided with a nozzle plate 30 having movable ranges with a uniform diameter of α1 can be formed by arranging silicon oxide film lateral walls 55*a* in the pressure chamber structure 50 thereof.

The group of ink jet heads 100 as described earlier can be produced, for example, by forming a large number of chips of ink jet heads on a single silicon wafer simultaneously and, subsequently, cutting the wafer to produce separate ink jet heads. Forming a large number of chips of ink jet heads simultaneously allows mass production of ink jet heads 100.

EXAMPLE 1

In Example 1, the first embodiment of ink jet head 100 was driven to operate by simulation using the finite element method. More specifically, in Example 1, the ink jet head 100 was driven to operate by simulation to see the characteristics of the ink jet head 100 by applying a drive voltage to the piezoelectric films 42 by means of the lower electrodes 41 and the upper electrodes 43 of the piezoelectric elements 40.

Figures 6, 7:
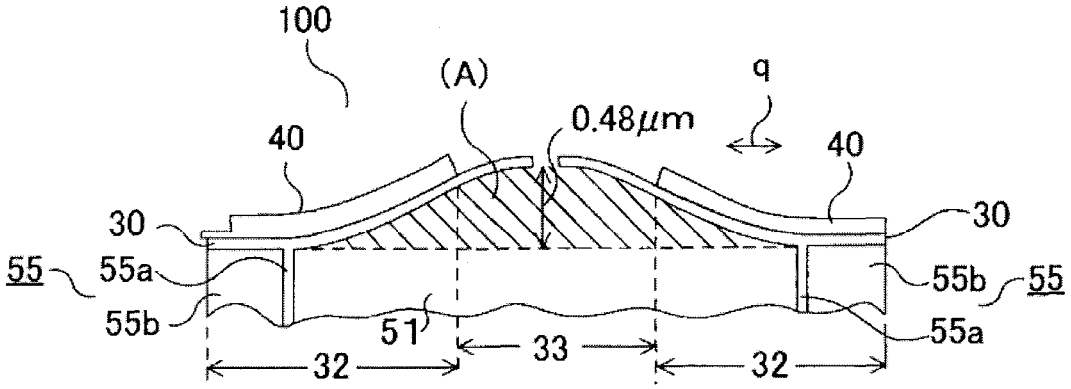
FIG. 6 is a illustration showing the sizes of some of the principle components of the ink jet head of the first embodiment (Example 1)
FIG. 7 is a schematic partial view of the nozzle plate of the first embodiment (Example 1) that is deformed.

Table 1 in FIG. 6 shows the sizes of some of the principle components of the inkjet head 100 used for the simulation. The diameter α1 of each of the pressure generating chambers 51 (the movable ranges α1 of the nozzle plate 30) of the silicon-made pressure chamber structure 50 of the inkjet head 100 at the side of the surface thereof that contacts the nozzle plate 30 was made to be equal to 200 μm. The thickness of the nozzle plate 30 of the silicon dioxide ($SiO_2$) formed on the surface of the pressure chamber structure 50 by means of CVD was made to be equal to 4 μm. The diameter of the aperture of each of the nozzles 31 on the nozzle plate 30 was made to be equal to 20 μm.

For each of the piezoelectric elements 40, the center section 33 of the nozzle plate 30 was made to show a diameter of 100 μm. The thickness of the lower electrode 41, the thickness of the piezoelectric film 42 and the thickness of the upper electrode 43 of the piezoelectric element 40 were made to be respectively equal to 0.1 μ, 2 μm and 0.1 μm. Platinum (Pt) was employed for the lower electrode 41 and the upper electrode 43 and lead zirconate titanate (PZT) was used for the piezoelectric film 42. The piezoelectric constant d31 of the piezoelectric films 42 was made to be equal to −100 μm/V.

FIG. 7 schematically illustrates how the nozzle plate 30 is deformed when a voltage of 30 V is applied between the lower electrode 41 and the upper electrode 43 of the piezoelectric element 40 as computationally determined by means of a simulator. As the voltage is applied, the piezoelectric film 42 contracts in the surface direction indicated by arrows q. As the piezoelectric film 42 contracts, the peripheral region 32 of the nozzle plate 30 is concavely deformed due to the bimorph effect. As the peripheral region 32 is deformed, the center section 33 where no piezoelectric film 42 is found on the nozzle plate 30 is convexly deformed in the upward direction that is perpendicular to the surface direction.

When a voltage of 30 V is applied between the lower electrode 41 and the upper electrode 43, the displacement of the nozzle plate 30 at the position of the nozzle 31 (the center of the pressure generating chamber 51) in the perpendicular direction relative to the nozzle plate 30 is 0.48 μm as computationally determined by means of the simulator. Then, the entire driven volume of the nozzle plate 30 indicated by oblique lines (shaded area A) in FIG. 7 is 5.1 pl (picoliter).

As a result of computations, the drive pressure that is required to displace the nozzle plate 30 by 0.48 μm at the center of the pressure generating chamber 51 is determined to be equal to 0.28 MPa and the total drive energy of the ink jet head 100 of Example 1 is determined to be equal to 0.71 nJ.

For example, when a droplet having a volume of 5 pl (picoliter) of ink that is made of organic solvent and aqueous solution is ejected at a speed of 10 m/s, the sum of the surface energy and the kinetic energy of the ink droplet is between about 0.1 to 0.3 nJ. Thus, it will be seen that the ink jet head 100 of Example 1 can produce driving energy sufficient for ejecting an ink droplet of a volume of about 5 pl (picoliter) at a speed of 10 m/s out of the ink contained in the pressure generating chamber 51.

Of the first embodiment, the pressure generating chambers 51 are formed to highly accurately show a diameter of α1 due to a high degree of etching accuracy as a result of arranging silicon oxide film lateral walls 55*a*, which show a low etching rate, in the pressure chamber structure 50 when forming the inkjet head 100. Therefore, the movable ranges of the nozzle plate 30 of the ink jet head 100 can be highly accurately set to show a constant diameter of α1. In other words, dispersion of shape and/or dimensions of the movable ranges of the nozzle plate 30 of the ink jet head 100 can be suppressed to provide stable ink ejection characteristics that are necessary for forming high definition images.

Thus, in the first embodiment of ink jet head 100, the pressure generating chambers 51 can be formed to a high degree of integration as the manufacturing accuracy for providing the movable ranges of the nozzle plate 30 is improved.

Then, as the pressure generating chambers 51 are formed to a high degree of integration, the nozzle plate 30 can be downsized and hence the entire ink jet head 100 can be downsized.

The structure of the first embodiment of inkjet head 100 is not subjected limitations. For example, the nozzle plate 30 and the piezoelectric elements 40 may be covered with insulating protection film from above. When the nozzle plate 30 and the piezoelectric elements 40 are covered with insulating protection film, the lower electrodes 41 or the upper electrodes 43 can be connected to the respective external wires 141, 143 by way of contact holes that are formed through the protection film.

(Second Embodiment)

The ink jet head 200 of the second embodiment of the present invention will be described by referring to FIGS. 8 through 10. The second embodiment differs from the first embodiment in that the piezoelectric elements of this embodiment are arranged in the respective center sections of the nozzle plate. The components of the second embodiment that are identical with those of the first embodiment are denoted by the same reference symbols and will not be described in detail repeatedly.

The piezoelectric elements are preferably arranged either near the centers or near the peripheries of the respective bulkheads for the purpose of effectively driving the nozzle plate for deformation by means of the piezoelectric elements that are arranged on the surface of the nozzle plate. For example, in the above-described first embodiment, the piezoelectric elements 40 are arranged near the peripheries of the respective bulkheads to make the center sections 33 free from the piezoelectric elements 40 and produce so many hole regions. On the other hand, in the second embodiment, the piezoelectric elements are arranged near the centers of the respective bulkheads to produce peripheral regions that are free from the piezoelectric elements.

Figure 8:
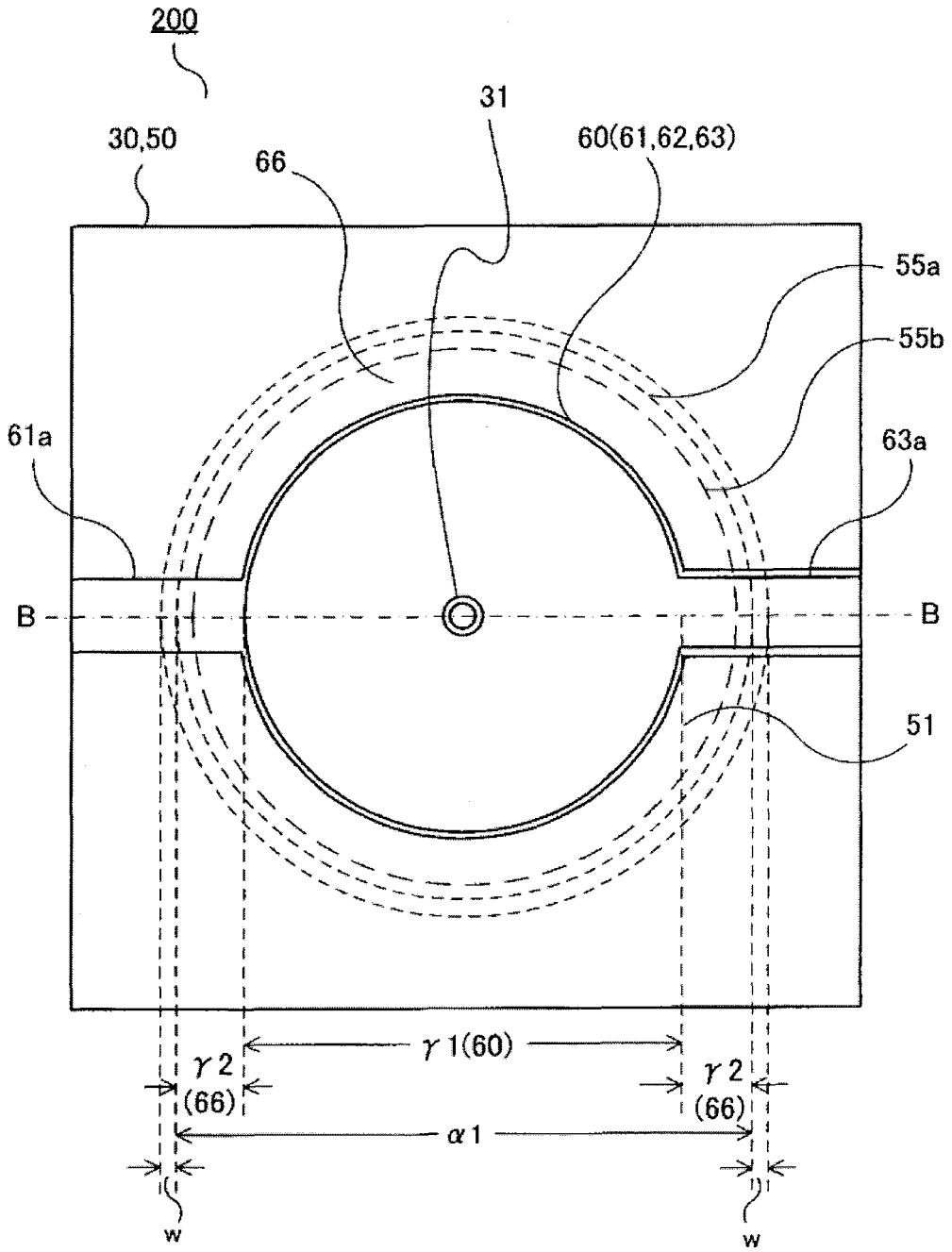
FIG. 8 is a partial top view of the second embodiment of ink jet head.
Figures 9, 10:
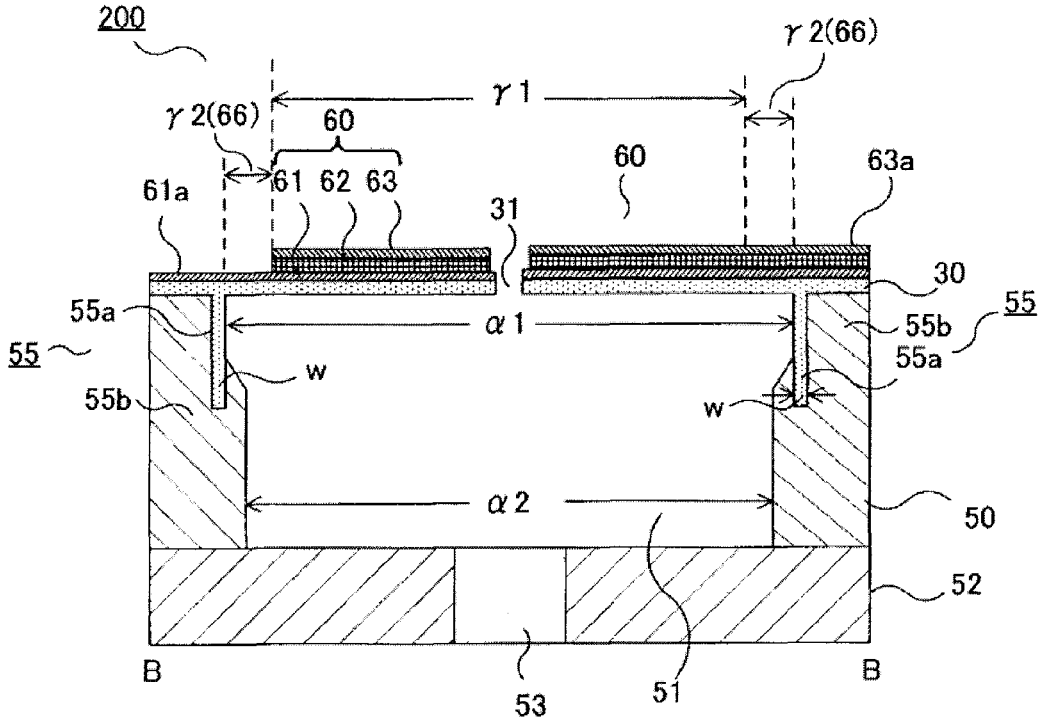
FIG. 9 is a schematic cross-sectional partial view of the second embodiment of ink jet head taken along line B-B in FIG. 8.
FIG. 10 is a illustration showing the sizes of some of the principle components of the ink jet head of the second embodiment (Example 2)

As shown in FIGS. 8 and 9, the piezoelectric elements 60 of this embodiment are flat elements having a diameter of $\gamma 1$ and arranged near the respective nozzles 31 of the nozzle plate 30 of the inkjet head 200. For each of the nozzles 31, a lower electrode 61 and an upper electrode 63 are laid to vertically sandwich a piezoelectric film 62, which is a piezoelectric body, between them to produce a multilayer structure. The lower electrode 61 is made to have an extended end part 61*a*, which operates as a part of an external wire 141. The upper electrode 63 is made to have an extended end part 63*a* along with the piezoelectric film 42 and the lower electrode 41 that are underlying layers so that the extended end part 63*a* operates as a part of an external wire 143.

An annular peripheral section 66 having a width of $\gamma 2$ is formed between the outer periphery of each of the piezoelectric elements 60 and the inner wall surface of the corresponding bulkhead 55. No piezoelectric element 60 is found in the peripheral section 66 except regions for connection with the external wires 141, 143.

The diameter $\gamma 1$ of the piezoelectric elements (the width $\gamma 2$ of the peripheral regions 66) may arbitrarily be determined so long as the nozzle plate is not prevented from being deformed at those positions when driven by the piezoelectric elements 60.

EXAMPLE 2

In Example 2, the second embodiment of ink jet head 200 was driven to operate by simulation using the finite element method. More specifically, in Example 2, the ink jet head 200 was driven to operate by simulation to see the characteristics of the ink jet head 200 by applying a drive voltage to each of the piezoelectric films 62 by means of the lower electrode 61 and the upper electrode 63 of the piezoelectric element 60 that includes them.

Table 2 in FIG. 10 shows the sizes of some of the principle components of the ink jet head 200 used for the simulation. The diameter $\alpha 1$ of each of the pressure generating chambers 51 (the movable ranges $\alpha 1$ of the nozzle plate 30) of the silicon-made pressure chamber structure 50 of the ink jet head 200 at the side of the surface thereof that contacts the nozzle plate 30 was made to be equal to 200 μm. The thickness of the nozzle plate 30 was made to be equal to 4 μm. The diameter of the aperture of each of the nozzles 31 on the nozzle plate 30 was made to be equal to 20 μm.

The diameter $\gamma 1$ of each of the piezoelectric elements 60 on the nozzle plate 30 was made to be equal to 140 μm. The thickness of the lower electrode 61, the thickness of the piezoelectric film 62 and the thickness of the upper electrode 63 of the piezoelectric element 60 were made to be respectively equal to 0.1 μ, 2 μm and 0.1 μm. Platinum (Pt) was employed for the lower electrode 61 and the upper electrode 63 and lead zirconate titanate (PZT) was used for the piezoelectric film 62. The piezoelectric constant d31 of the piezoelectric films 42 was made to be equal to −100 μm/V, which is same as its counterpart of Example 1. The area of the pressure generating chamber 51 is made to be substantially equal to its counterpart of Example 1.

When a voltage of 30 V is applied between the lower electrode 61 and the upper electrode 63, the nozzle plate 30 is computationally determined to be displaced by 0.53 μm in the perpendicularly upward direction at the position of the nozzle 31 (the center of the pressure generating chamber 51) as a result of the simulation. Then, the entire driven volume of the nozzle plate 30 indicated by oblique lines (shaded area A) in FIG. 7 is 5.8 pl (picoliter).

As a result of computations, the drive pressure that is required to displace the nozzle 31 by 0.53 μm at the center of the pressure generating chamber 51 is determined to be equal to 0.26 MPa and the total drive energy of the ink jet head 100 of Example 2 is determined to be equal to 0.77 nJ.

When compared with Example 1, in which the piezoelectric element 40 is arranged near the periphery of the pressure generating chamber 50 under the nozzle plate 30, the drive energy of Example 2, in which the piezoelectric element 60 is arranged near the center of the pressure generating chamber 50 under the nozzle plate 30, is greater than that of Example 1 by about 5%.

On the other hand, in Example 2 in which the piezoelectric element 60 is arranged near the center of the pressure generating chamber 50, the end parts 61*a*, 63*a* of the electrodes that are to be connected respectively to the external wires 141, 143 need to be drawn out on the nozzle plate 30. All in all, Example 1 in which the lower electrode 41 and the upper electrode 43 are connected respectively to the external wires 141, 143 on the bulk head 55 is superior to Example 2 in which the end parts 61*a*, 63*a* of the electrodes arranged at part of the annular peripheral section 66 in terms of symmetry of deformation of the nozzle plate 30. The inkjet head of Example 1, which is superior to that of Example 2 in terms of symmetry of deformation, shows ink ejection characteristics that are more stable than the ink ejection characteristics of the ink jet head of Example 2. Additionally, the ink jet head of Example 1 is less limited in terms of the directions of drawing out the end parts 61*a*, 63*a* of the electrodes and hence provided with a higher degree of design freedom if compared with the ink jet head of Example 2.

The ink jet head 200 of the second embodiment is provided with silicon oxide film lateral walls 55*a* to suppress dispersion of manufacturing accuracy of the pressure generating chambers 51. Therefore, the movable ranges of the nozzle plate 30 can highly accurately be held to be equal to the diameter α1. In other words, the dispersion of shape and/or dimensions of the movable ranges of the nozzle plate 30 of the ink jet head 200 can be suppressed so that stable ink ejection characteristics can be obtained for the ink that is ejected from the nozzle 31 to form high definition images.

According to the second embodiment, since the movable ranges of the nozzle plate 30 can be produced highly accurately, the nozzle plate 30 and hence the ink jet head 200 can effectively be downsized. Additionally, the ink jet head 200 of the second embodiment can improve the drive energy and operate as energy-saving ink jet head if compared with the ink jet head 100 of the first embodiment because the piezoelectric elements 60 are arranged near the centers of the respective bulkheads on the nozzle plate 30.

(Exemplar Modification of Second Embodiment)

Figure 11:
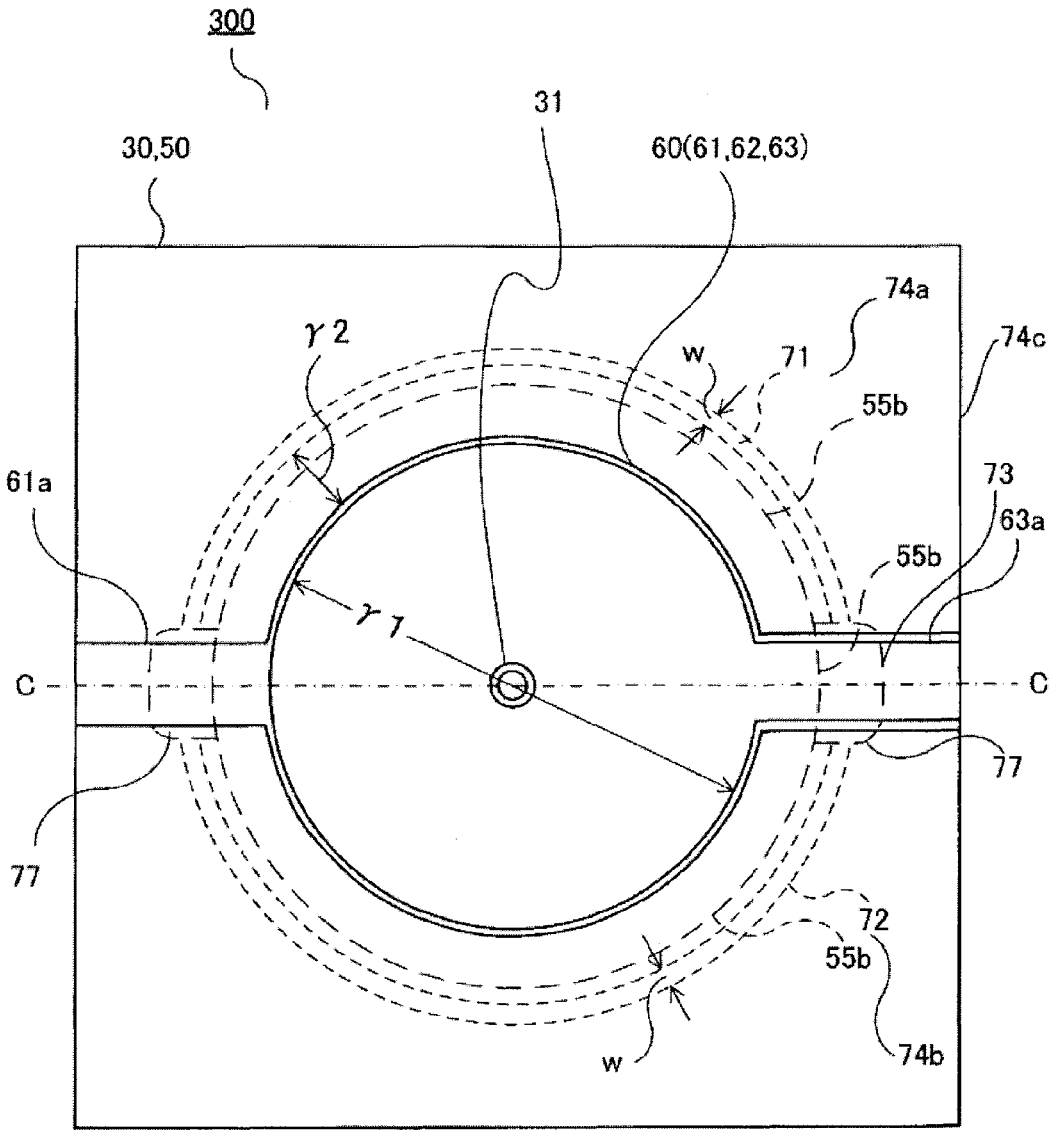
FIG. 11 is a schematic partial top view of an exemplar modification of the second embodiment of ink jet head.
Figure 12:
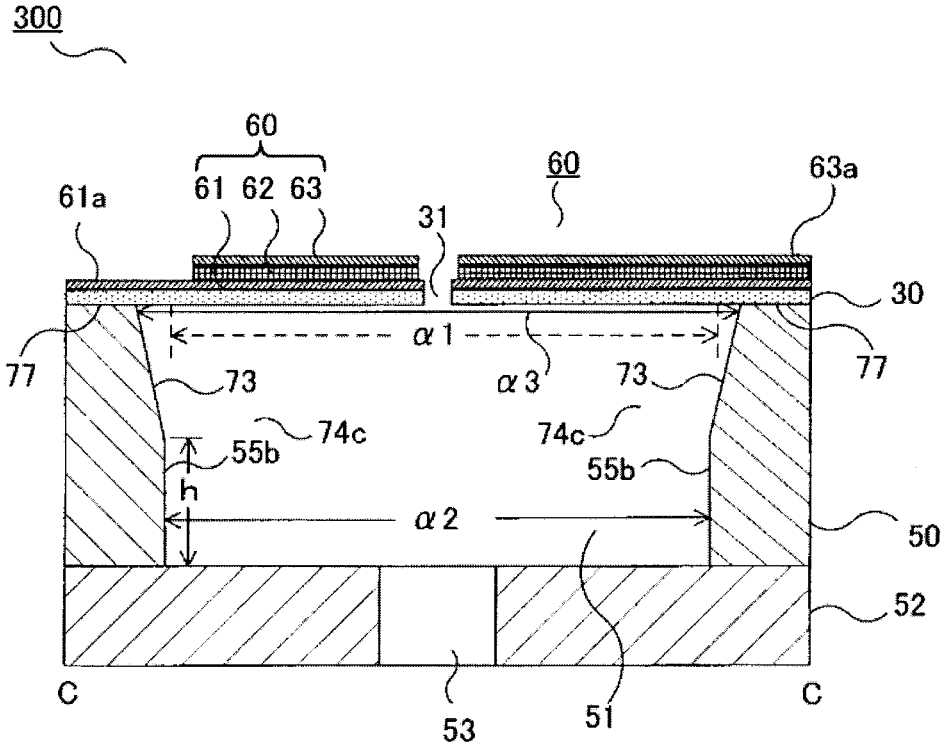
FIG. 12 is a schematic cross-sectional partial view of the ink jet head taken along line C-C in FIG. 11.

The structure of the second embodiment of ink jet head is not subjected to any particular limitations. For example, the silicon oxide film lateral walls do not necessarily need to be annular-shaped but each of the silicon oxide film lateral walls may be divided into a plurality of wall members as shown in FIGS. 11 and 12.

When a silicon oxide film lateral walls are formed in the pressure chamber structure, undulations can be formed on the nozzle plate in some of the areas located right on the silicon oxide film lateral walls due to process variation factors of the film forming process such as variability of oxidizing conditions. When the electrodes of the piezoelectric elements are wired to ride over the undulations that are formed on the nozzle plate, some of the wires can be broken due to the undulations.

In the modified second embodiment, each of the silicon oxide film lateral walls is divided into a plurality of wall members and the electrodes of each of the piezoelectric elements are wired through the zones that are free from the silicon oxide film lateral wall members, which will be referred to as dividing zones 77 hereinafter.

In the modified ink jet head 300, each of the piezoelectric elements 60 is provided with a first silicon oxide film lateral wall 71 and a second silicon oxide film lateral wall 72 with the dividing zones 77 interposed between them. The first and second silicon oxide lateral walls 71, 72 are circular arc-shaped and the electrode end parts 61*a*, 63*b* of the piezoelectric element 60 are arranged in the dividing zones. Thus, the first and second silicon oxide lateral walls 71, 72 show a profile same as that of an annular silicon oxide film lateral wall 55*a* except the dividing zones 77.

The nozzle plate 30 is formed integrally with the bulkheads 74*a* and the bulkheads 74*b* of the pressure chamber structure 50 in the regions of the pressure generating chambers except the dividing zones 77. In each of the regions of the pressure generating chambers, the bulkhead 74*a* is provided with a first silicon oxide film lateral wall 71 and a silicon film lateral wall 55*b*, while the bulkhead 74*b* is provided with a second silicon oxide film lateral wall 72 and a silicon film lateral wall 55*b*. In each of the regions of the pressure generating chambers except the dividing zones 77, the top ends of the first and second silicon oxide film lateral walls 71, 72 and the top end of the silicon film lateral wall 55*b* are rigidly secured to the nozzle plate 30.

As shown in FIG. 12, the bulkhead 74*c* in each of the dividing zones 77 includes a vertically disposed silicon lateral wall 55*b* and a tapered silicon film lateral wall 73.

If compared with the first and second silicon oxide film lateral walls 71, 72, the silicon film lateral wall 73 show a high etching rate. Therefore, each of the pressure generating chambers 51 shows a width α3 in the dividing zones 77 that is greater than the width (inner diameter) α1 of the regions thereof where the first and second silicon oxide film lateral walls 71, 72 are found. Thus, each of the movable ranges of the nozzle plate 30 shows a diameter of α1 in the regions where the first and second silicon oxide film lateral walls 71, 72 are found and a diameter of α3 in the dividing zones 77.

It should be noted, however, that each of the movable ranges of the nozzle plate 30 shows a diameter of α1 in most of the range due to the silicon oxide film lateral walls 71, 72 and hence the deformation behavior of the nozzle plate 30 in the movable ranges is scarcely influenced by the diameter α3 in the dividing zones 77. Therefore, if the dividing zones are provided, the nozzle plate 30 can suppress dispersion of the movable ranges of the nozzle plate 30 and shows stable characteristics in terms of ink ejection from the nozzles 31.

Additionally, the electrode end parts 61*a*, 63*a* of each of the piezoelectric elements 60 are arranged on the respective dividing zones 77 that are free from the silicon oxide film lateral walls 71, 72. The nozzle plate 30 is held flat in the dividing zones 77. Therefore, the risk of breaking of wire due to undulations that can arise on the nozzle plate 30 is eliminated so that ink jet heads 300 can be produced at a high yield.

Note that each of the silicon oxide film lateral walls does not necessarily be divided into two wall members. Each of the silicon oxide film lateral walls may alternatively be divided into four or six wall members. However, from the viewpoint of driving the silicon plate 30 for symmetric deformation and smoothly ejecting ink droplets, the dividing zones of each of the silicon oxide film lateral walls are preferably arranged point-symmetrically with the point of symmetry located at the center of the pressure generating chamber.

Thus, with the above-described modified embodiment, the ink jet head 300 is provided with silicon oxide film lateral walls 71, 72 to suppress dispersion of manufacturing accuracy of the pressure generating chambers 51. Therefore, all the movable ranges of the nozzle plate 30 can substantially be made to show the same diameter of α1. In other words, the dispersion of shape and/or dimensions of the movable ranges of the nozzle plate 30 of the ink jet head 300 can be suppressed to provide stable characteristics in terms of ink ejection from the nozzles 31 that are necessary for forming high definition images. Like the second embodiment, the ink jet head 300 of this modified embodiment can be downsized for the purpose of energy saving.

Furthermore, this modified embodiment is free from breaking of wire of at the electrode end parts 61*a*, 63*a* because the electrode end parts 61*a*, 63*a* are arranged in the dividing zones 77 where the nozzle plate 30 is flat. Thus, the yield of manufacturing ink jet heads 300 can be improved.

(Third Embodiment)

Figure 13:
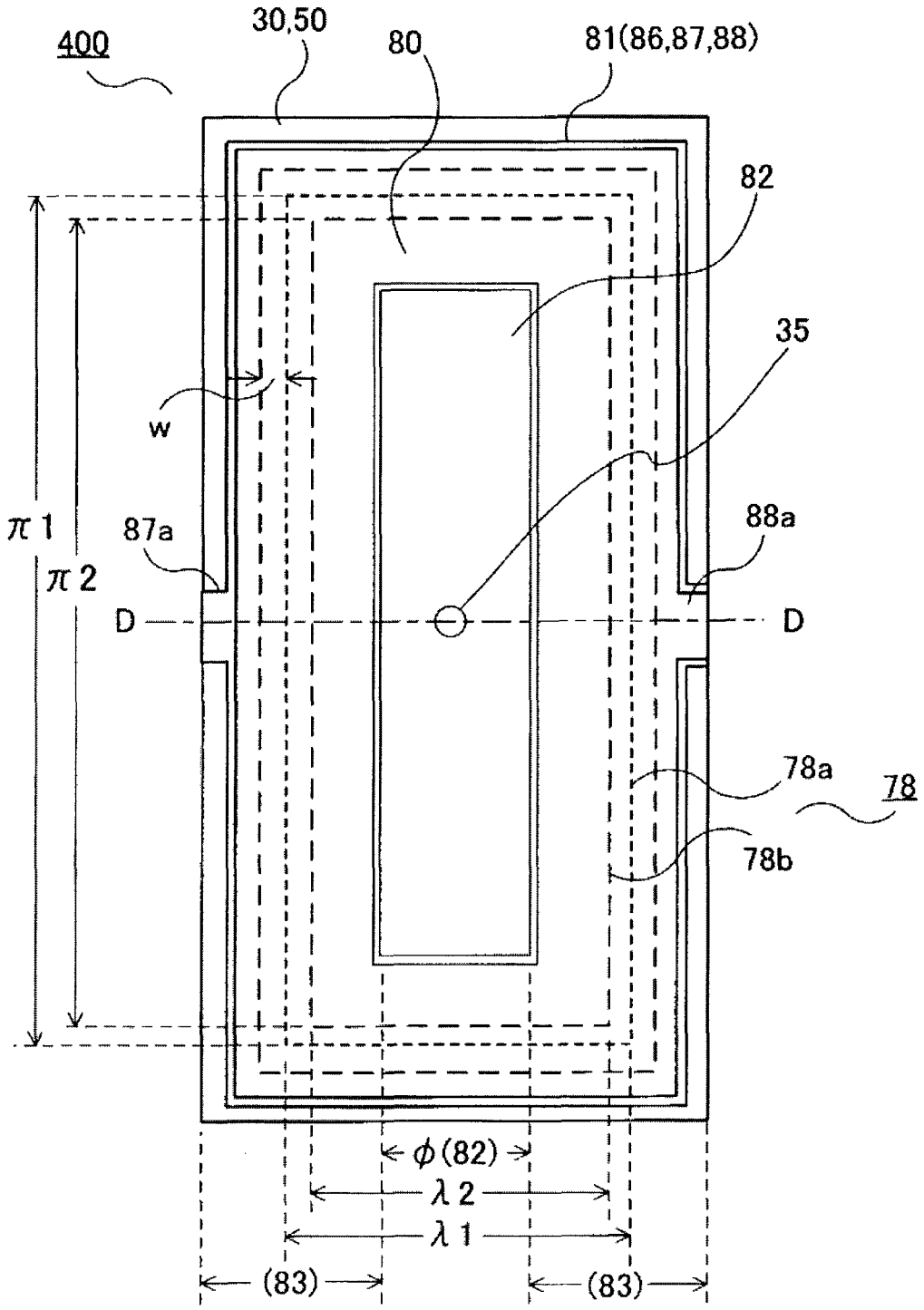
FIG. 13 is a partial top view of the third embodiment of ink jet head.

The third embodiment of ink jet head 400 will be described below by referring to FIGS. 13 through 15. Unlike the first embodiment, the pressure generating chambers of the third embodiment are made to show a rectangular plan view. The components of the third embodiment that are identical with those of the first embodiment are denoted by the same reference symbols and will not be described in detail repeatedly.

The ink jet head 400 includes pressure generating chambers 80 that show a rectangular plan view with a width of λ1 and a length of π1 and are formed in the pressure chamber structure 50 thereof. Each of the pressure generating chambers 80 is surrounded by a nozzle plate 30, a bulkhead 78 and a back plate 52.

The bulkhead 78 includes a rectangular frame-shaped silicon oxide film lateral wall 78*a* that shows a width of λ1 and a length of π1 at the inner periphery thereof and a rectangular silicon film lateral wall 78*b* that shows a width of λ2 and a length of π2 at the inner periphery thereof and is designed to operate as an etching surface of the pressure chamber structure 50. Thus, each of the pressure generating chambers 80 has a region of λ1×π1 at the inner periphery thereof and a region of λ2×π2 at the inner periphery thereof.

The nozzle plate 30 is typically made of silicon dioxide ($SiO_2$) film that is integrally formed with the pressure chamber structure 50. In other words, the nozzle plate 30 is integrally formed with the bulkheads 78 of the pressure chamber structures 50. The top end of the silicon oxide film lateral wall 78*a* and the top end of the silicon film lateral wall 78*b* of each of the bulkheads 78 are rigidly secured to the nozzle plate 30. The nozzle plate 30 has movable ranges with a size of λ1×π1 that is defined by the silicon oxide film lateral walls 78*a*.

The nozzle plate 30 has a nozzle 35 at the center of each of the pressure generating chambers 80 (e.g., at the intersection of the diagonals of the plan view of the pressure generating chamber 80). The nozzle plate 30 has rectangular piezoelectric elements 81 that have a profile similar to that of the pressure generating chambers 80. Each of the piezoelectric elements 81 has a rectangular center section 82 that surrounds the nozzle 35 and has a profile similar to that of the pressure generating chambers 80. No piezoelectric element 81 is found in the center section 82. For each of the piezoelectric elements 81, a lower electrode 87 and an upper electrode 88 are laid to vertically sandwich a piezoelectric film 86, which is a piezoelectric body, between them and produce a multilayer structure. The lower electrode 87 is made to have an extended part 87*a*, which operates as a part of an external wire 141. The upper electrode 88 is made to have an extended part 88*a* along with the piezoelectric film 86 and the lower electrode 87 that are underlying layers so that the extended part 88*a* operates as a part of an external wire 143.

Each of the piezoelectric elements 81 extends from above the corresponding bulkhead 78 of the nozzle plate 30 to above the pressure generating chamber 80 and toward the corresponding nozzle 35 so that it is formed above the peripheral region 83 of the pressure generating chamber 80. The center section 82 of the nozzle plate 30, in which no piezoelectric element 81 is found, can freely fluctuate in the thickness direction. The size of the center sections 82 of the nozzle plate 30 is not subjected to any limitations so long as the nozzle plate 30 can be made to fluctuate by the operation of the piezoelectric elements 81.

At the time of manufacturing the ink jet head 400, frame-shaped grooves having a plan view size of λ1×π1 and a depth of w are formed in the pressure chamber structure 50. Then, a nozzle plate 30 of silicon oxide film ($SiO_2$) and silicon oxide film lateral walls 78*a* are formed by thermally oxidizing the pressure chamber structure 50 having the grooves. Piezoelectric elements 81 and nozzles 35 are formed at the nozzle plate 30 and subsequently pressure generating chambers 80 are formed in the pressure chamber structure 50.

More specifically, the pressure chamber structure 50 is subjected to an etching process by means of D-RIE to produce pressure generating chambers 80, using a low etching rate for the silicon dioxide film ($SiO_2$) relative to silicon (Si). The pressure chamber structure 50 is reliably etched along the inner peripheries of λ1×π1 of the silicon oxide film lateral walls 78*a* without over-etching. As a result of arranging the silicon oxide film lateral walls 78*a*, the shape and the size of each of the pressure generating chambers 80 at the side that is held in contact with the nozzle plate 30 and hence those of the movable ranges of the nozzle plate 30 can be highly accurately set to be constantly equal to λ1×π1.

EXAMPLE 3

In Example 3, the third embodiment of ink jet head 400 was driven to operate by simulation using the finite element method. More specifically, in Example 3, the ink jet head 400 was driven to operate by simulation to see the characteristics of the ink jet head 400 by applying a drive voltage to each of the piezoelectric films 86 by means of the lower electrode 87 and the upper electrode 88 of the piezoelectric element 81.

Figures 14, 15:
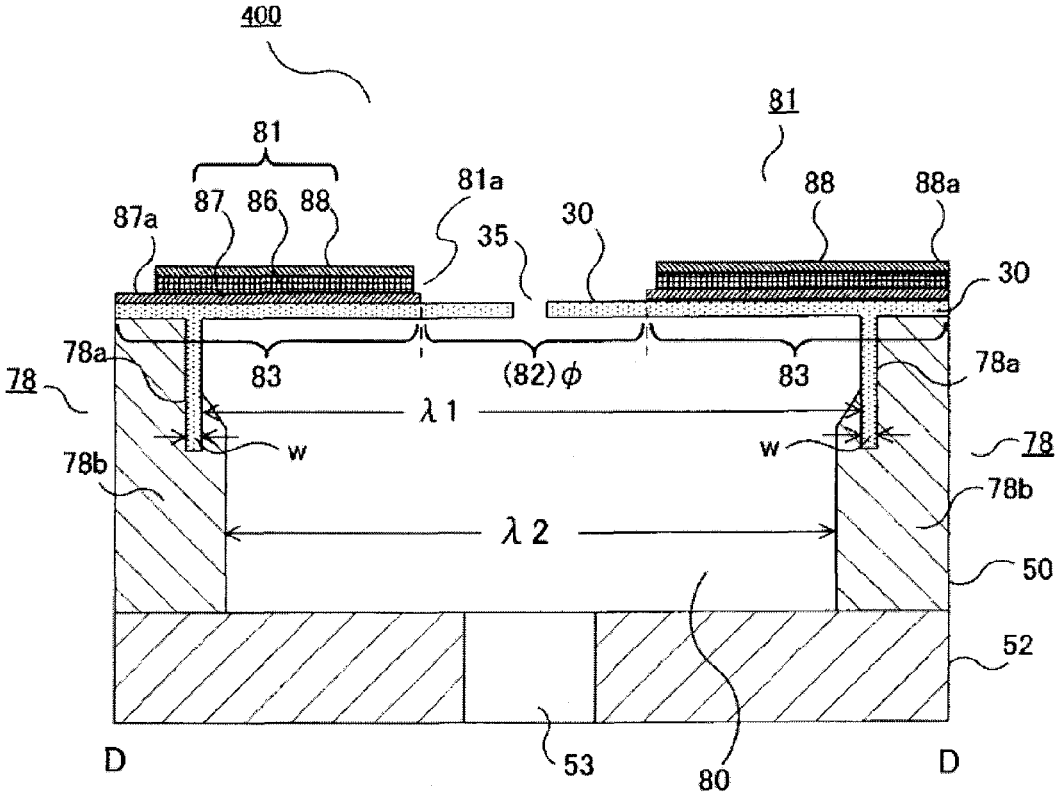
FIG. 14 is a schematic cross-sectional partial view of the third embodiment of ink jet head taken along line D-D in FIG. 13.
FIG. 15 is a illustration showing the sizes of some of the principle components of the ink jet head of the third embodiment (Example 3)

Table 3 in FIG. 15 shows the sizes of some of the principle components of the ink jet head 400 used for the simulation. The width λ1 and the length π1 of each of the pressure generating chambers 80 (the movable ranges λ1 of the nozzle plate 30 in the width direction) of the silicon-made pressure chamber structure 50 of the inkjet head 400 were respectively made to be equal to 100 μm and 400 μm. Thus, the area $100\times400\ (\mu m)^2$ of each of the pressure generating chambers 80 was made close to the area $100\times100\times\pi(\mu m)^2$ of each of the pressure generating chambers 51 of Example 1.

The thickness of the nozzle plate 30 of the silicon dioxide ($SiO_2$) film formed on the surface of the pressure chamber structure 50 by means of CVD was made to be equal to 4 μm. The diameter of the aperture of each of the nozzles 35 on the nozzle plate 30 was made to be equal to 20 μm. The center section 82 in each of the piezoelectric elements 81 on the nozzle plate 30 was made to show a width ϕ of 30 μm. The thickness of the lower electrode 87, the thickness of the piezoelectric film 86 and the thickness of the upper electrode 88 of the piezoelectric element 81 were made to be respectively equal to 0.1 μ, 2 μm and 0.1 μm.

Platinum (Pt) was employed for the lower electrode 87 and the upper electrode 88 and lead zirconate titanate (PZT) was used for the piezoelectric film 86. The piezoelectric constant d31 of the piezoelectric films 86 was made to be equal to −100 μm/V. The residual stress in the formed film of the nozzle plate 30 was made to be equal to 0 MPa, while the residual stress in the formed piezoelectric film 86 was made to be equal to 56 MPa.

As a result of computations conducted for simulation of an instance where a voltage of 30 V is applied between the lower electrode 87 and the upper electrode 88 of the piezoelectric element 81, the nozzle plate 30 is displaced by 0.23 μm in the vertical direction at the position of nozzle 35 (at the center of the nozzle plate 30). The driven volume of the entire nozzle plate 30 is 3.7 pl (picoliter).

As a result of computations, the drive pressure that is required to displace the nozzle plate 30 by 0.23 μm at the center of the nozzle plate 30 is determined to be equal to 0.69 MPa and the total drive energy of the ink jet head 400 of Example 3 is determined to be equal to 1.29 nJ.

Thus, the drive force that is exerted by the piezoelectric element 81 arranged in the length direction of π1 on the nozzle plate 30 of the ink jet head 400 of Example 3 is small if compared with the ink jet head 100 of Example 1. On the other hand, the nozzle plate 30 of the inkjet head 400 of Example 3 can easily fluctuate if compared with the ink jet head 100 of Example 1 in which the nozzle plate 30 is evenly restricted for fluctuations along the periphery of the nozzle 31 by the piezoelectric element 40.

Therefore, the driven volume of the nozzle plate 30 of the ink jet head 400 of Example 3 is small but the total drive energy required to the ink jet head 400 of Example 3 is large if compared with the ink jet head 100 of Example 1. In other words, the quantity of ink that is ejected from the ink jet head 400 of Example 3 at a time is as small as about 70% of the quantity of ink that is ejected from the ink jet head 100 of Example 1 but the ink ejection energy of the ink jet head 400 of Example 3 is 1.7 times of the ink ejection energy of the ink jet head 100 of Example 1. Thus, it will be understood that the ink jet head 400 of Example 3 is suited for ejecting highly viscous ink if compared with the ink jet head 100 of Example 1.

The ink jet head 400 of the third embodiment is provided with silicon oxide film lateral walls 78*a* to suppress dispersion of manufacturing accuracy of the pressure generating chambers 80. Thus, the size of the movable ranges of the nozzle plate 30 of the ink jet head 400 can be highly accurately set to a constant value of $\lambda 1 \times \pi 1$. In other words, the dispersion of shape and/or dimensions of the movable ranges of the nozzle plate 30 of the ink jet head 400 can be suppressed to provide stable ink ejection characteristics that are necessary for forming high definition images.

Thus, in the third embodiment of ink jet head 400, the pressure generating chambers 80 can be formed to a high degree of integration as the manufacturing accuracy for providing the movable ranges of the nozzle plate 30 is improved. Then, as the pressure generating chambers 80 are formed to a high degree of integration, the nozzle plate 30 can be downsized and hence the entire ink jet head 400 can be downsized.

Additionally, the third embodiment of ink jet head 400 can provide large energy for ink ejection, although the quantity of ink it can eject at a time is smaller than ink jet heads having pressure generating chambers that are circular in a plan view. Thus, the ink jet head 400 of Embodiment 3 is suited for ejecting highly viscous ink if compared with ink jet heads having pressure generating chambers that are circular in a plan view.

The structure of the third embodiment of inkjet head 400 is not subjected limitations. For example, the ink jet head 400 may be provided with insulating film arranged on the top surfaces of the piezoelectric elements 81 and the lower electrodes 87 or the upper electrodes 88 may be connected to the respective external wires by way of contact holes that are formed through the insulating film. Furthermore, each of the piezoelectric elements may be formed in the center section of the nozzle plate.

(Fourth Embodiment)

Figure 16:
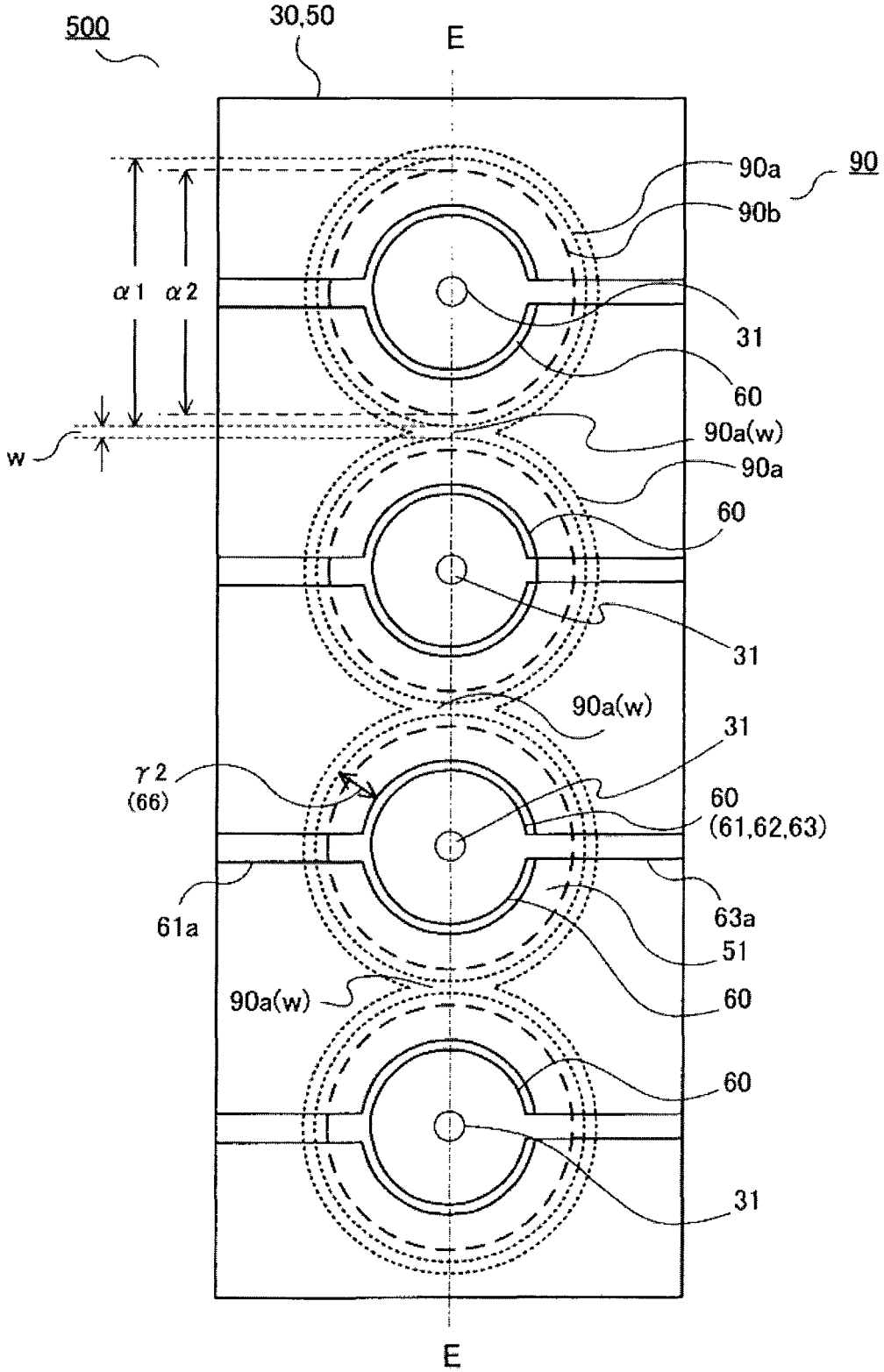
FIG. 16 is a partial top view of the fourth embodiment of ink jet head.
Figure 17:
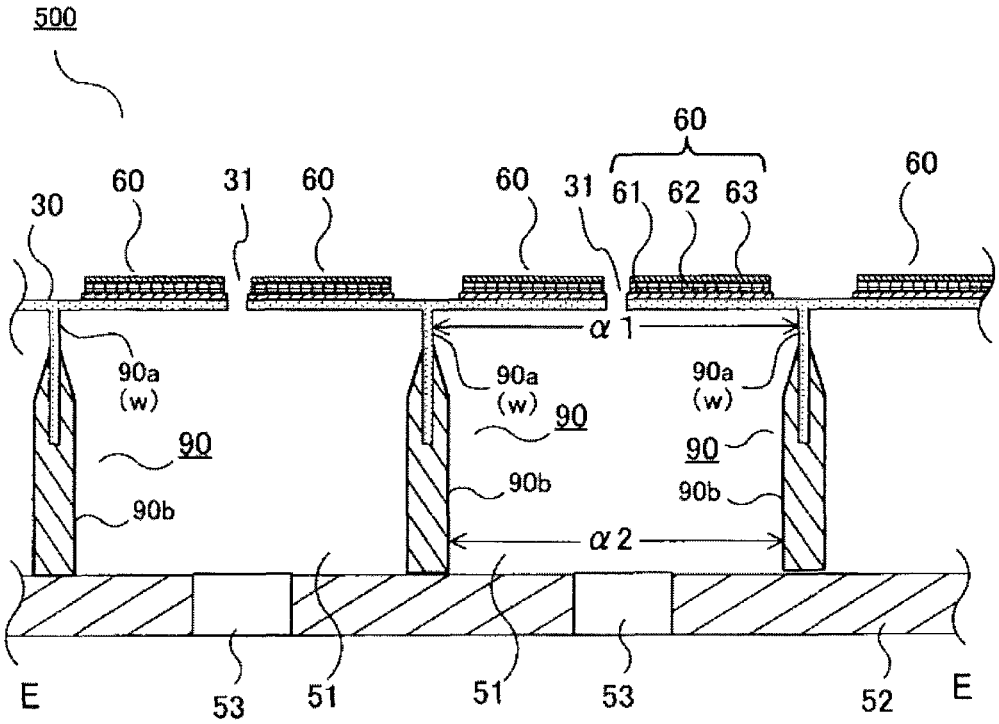
FIG. 17 is a schematic cross-sectional partial view of the fourth embodiment of ink jet head taken along line E-E in FIG. 16.

The fourth embodiment of ink jet head 500 will be described below by referring to FIGS. 16 and 17. The fourth embodiment differs from the second embodiment in that the plurality of pressure generating chambers that are formed in the pressure chamber structure are arranged such that the annular silicon oxide film lateral walls of any two adjacent pressure generating chambers are held in contact with each other. The components of the fourth embodiment that are identical with those of the second embodiment are denoted by the same reference symbols and will not be described in detail repeatedly.

Of the plurality of pressure generating chambers 51, which are formed in the pressure chamber structure 50 of the ink jet head 500, any two adjacently located pressure generating chambers 51 share a common bulkhead 90. Each of the bulk heads includes an annular silicon oxide film lateral wall 90*a* having an inner diameter (diameter) of $\alpha 1$ and a thickness of w and a silicon film lateral wall 90*b* having an inner diameter (diameter) of $\alpha 2$ and designed to operate as an etching surface of the pressure chamber structure 50.

The nozzle plate 30 is made of silicon dioxide ($SiO_2$) film that is integrally formed with the pressure chamber structure 50 and also with the bulkheads 90 of the pressure chamber structure 50. The tops end of the silicon oxide lateral walls 90*a* and the top ends of silicon film lateral walls 90*b* are rigidly secured to the nozzle plate 30. For each of the pressure generating chambers 51, the nozzle plate 30 has a movable range having a diameter of $\alpha 1$ that is defined by the corresponding silicon oxide film lateral wall 90*a*.

Annular grooves having an inner diameter of $\alpha 1$ are formed in the pressure chamber structure 50 when manufacturing the ink jet head 500. The annular grooves are formed such that they are shared by the pressure generating chambers 51 in the regions where any two adjacent pressure generating chambers are arranged side by side and held in contact with each other. The pressure chamber structure 50 having the grooves is thermally oxidized to produce a nozzle plate 30 of silicon dioxide ($SiO_2$) film and silicon oxide lateral walls 90*a*. Piezoelectric elements 60 and nozzles 31 are formed at the nozzle plate 30 and subsequently pressure generating chambers 51 are formed in the pressure chamber structure 50.

More specifically, the pressure chamber structure 50 is subjected to an etching process by means of D-RIE to produce pressure generating chambers 51, using a low etching rate for the silicon dioxide film ($SiO_2$) relative to silicon (Si). The pressure chamber structure 50 is reliably etched along the inner peripheries having an inner diameter of $\alpha 1$ of the silicon oxide film lateral walls 90*a* without over-etching. As a result of arranging the silicon oxide film lateral walls 90*a*, the etching areas of the pressure generating chambers 51 at the side of the surface thereof that contacts the nozzle plate 30, more specifically the movable ranges of the nozzle plate 30, can be highly accurately set to constantly show a diameter that is equal to $\alpha 1$.

Additionally, since any two adjacently located pressure generating chambers 51 share a bulkhead 90, the pressure generating chambers 51 can be formed to a high degree of integration. Then, the density of arrangement of the nozzles 31 of the inkjet head 500 can be raised. Note that the adjacently arranged pressure generating chambers may not necessarily show a circular plan view. Adjacently arranged pressure generating chambers can share a common bulkhead when the pressure generating chambers show a polygonal plan view.

Thus, the ink jet head 500 of the fourth embodiment is provided with silicon oxide film lateral walls 90*a* to suppress dispersion of manufacturing accuracy of the pressure generating chambers 51. Therefore, the movable ranges of the nozzle plate 30 can highly accurately be held to be constantly show a diameter that is equal to $\alpha 1$. In other words, the dispersion of shape and/or dimensions of the movable ranges of the nozzle plate 30 of the ink jet head 500 can be suppressed so that stable ink ejection characteristics can be obtained for the ink that is ejected from the nozzle 31 to form high definition images.

In the fourth embodiment of ink jet head 500, any two adjacently located pressure generating chambers 51 share a common bulkhead 90. Therefore, the pressure generating chambers 51 can be formed to a high degree of integration. Then, the nozzles 31 of the fourth embodiment of ink jet head 500 can be formed to a high degree of integration with a high density of arrangement so that the ink jet head 500 can be downsized and form high definition images.

In the above-described embodiments, the shape and/or the dimensions of the pressure generating chambers are not subjected to limitations. For example, the pressure generating chambers may show a rhombic, elliptic or polygonal plan view depending on the application of the ink jet head. The shape, the size and/or the thickness of the etching limiter may be arbitrarily determined so long as the pressure generating chambers can highly accurately be formed. The silicon oxide film ($SiO_2$) may be replaced by some other inorganic material such as silicon nitride film (SiN) or by a metal material such as aluminum (Al) or tungsten (W). The shape and the material of the piezoelectric elements are not subjected to limitations either. The piezoelectric characteristics of the piezoelectric bodies may also arbitrarily be determined.

Furthermore, the structure of the ink jet head is not subjected to limitations. For example, the ink jet head may not necessarily be provided with a back plate, in which ink supply holes having a small hole diameter smaller than the diameter of the pressure generating chambers to be formed and which is arranged between the pressure generating chambers and the ink flow path. However, when no back plate is arranged between the pressure generating chambers and the ink flow path, the pressure generating chambers preferably have a large dimension in the depth direction. As the pressure generating chambers are made to have a large dimension in the depth direction, the energy change that arises in each of the pressure generating chambers and travels to eventually reach the ink flow path as the nozzle plate is deformed can be delayed.

In at least one of the above-described embodiments, silicon oxide film lateral walls that show a low etching rate is arranged in the pressure chamber structure. When the pressure generating chambers are produced by etching, the inner peripheries of the silicon oxide film lateral walls are etched with a high degree of manufacturing accuracy. Therefore, the movable ranges of the nozzle plate of the ink jet head can constantly be set to a given value so that stable ink ejection characteristics can be obtained for the ink that is ejected from the nozzles to form high definition images. Additionally, since the movable ranges of the nozzle plate can be produced highly accurately, the nozzle plate and hence the ink jet head can effectively be downsized.

While certain embodiments have been described, these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. An ink jet head comprising:

a pressure chamber disposed in a pressure chamber structure and configured to be filled with ink, the pressure chamber including a lateral wall disposed on an inner wall of the pressure chamber structure and made of a first material different from a second material of the inner wall;

a nozzle plate that forms a part of the pressure chamber and has a nozzle, the nozzle plate being formed of the first material and rigidly secured with the lateral wall so that the nozzle plate is movable only within a diameter defined by the lateral wall; and a flat driver comprising a piezoelectric body disposed on a surface of the nozzle plate opposite the pressure chamber, the flat driver configured to change a volume of the pressure chamber by deforming the nozzle plate.

2. The ink jet head according to claim 1, wherein the second material is silicon.

3. The ink jet head according to claim 1, wherein the lateral wall is formed when the nozzle plate is formed on the pressure chamber structure by means of the same process.

4. The ink jet head according to claim 1, comprising a plurality of the pressure chambers;

wherein any two adjacently located pressure chambers partly share their lateral wall.

5. The ink jet head according to claim 1, wherein the pressure chamber shows a circular plan view.

6. The ink jet head according to claim 1, wherein the pressure chamber shows a polygonal plan view.

7. The ink jet head according to claim 1, wherein the lateral wall is made of silicon oxide.

8. The ink jet head according to claim 1, wherein a ratio of the thickness of the lateral wall to the nozzle plate is not less than 2.

9. An ink jet recording apparatus comprising:

a pressure chamber disposed in a pressure chamber structure and configured to be filled with ink, the pressure chamber including a lateral wall disposed on an inner wall of the pressure chamber structure and made of a first material different from a second material of the inner wall;

a nozzle plate that forms a part of the pressure chamber and has a nozzle, the nozzle plate being formed of the first material and rigidly secured with the lateral wall so that the nozzle plate is movable only within a diameter defined by the lateral wall;

a flat driver comprising a piezoelectric body disposed on a surface of the nozzle plate opposite the pressure chamber, the flat driver configured to change a volume of the pressure chamber by deforming the nozzle plate; and a conveyor for conveying a recording medium to the position where ink is ejected from the nozzle.

10. The ink jet recording apparatus according to claim 9, wherein the second material is silicon.

11. The ink jet recording apparatus according to claim 9, wherein the lateral wall is formed when the nozzle plate is formed on the pressure chamber structure by means of the same process.

12. The ink jet recording apparatus according to claim 9, comprising a plurality of the pressure chambers;

wherein any two adjacently located pressure chambers partly share their lateral wall.

13. The ink jet recording apparatus according to claim 9, wherein the pressure chamber shows a circular plan view.

14. The ink jet recording apparatus according to claim 9, wherein the pressure chamber shows a polygonal plan view.

15. The ink jet recording apparatus according to claim 9, wherein the lateral wall is made of silicon oxide.

16. The ink jet recording apparatus according to claim 14, wherein when the thickness of the nozzle plate is 1, the thickness of the silicon oxide film lateral walls is not less than 2.

* * * * *